United States Patent [19]

LaFata

[11] Patent Number: 5,042,819

[45] Date of Patent: Aug. 27, 1991

[54] TARGET BUBBLE GENERATION AND TARGET SHOOTING SYSTEM

[76] Inventor: John E. LaFata, 2129 Ocean Dr., Oxnard, Calif. 93035

[21] Appl. No.: 580,145

[22] Filed: Sep. 10, 1990

[51] Int. Cl.[5] ..... A63H 33/28; A63F 9/02

[52] U.S. Cl. ..... 273/349; 446/16

[58] Field of Search ..... 273/349, 1 L; 446/15, 446/16, 17, 18

[56] References Cited

U.S. PATENT DOCUMENTS

| | | | |
|---|---|---|---|
| 2,832,173 | 4/1958 | Winfield | 446/16 |
| 4,248,436 | 2/1981 | Corrigan | 273/349 |
| 4,775,348 | 10/1988 | Collins | 446/16 |

*Primary Examiner*—William H. Grieb

*Attorney, Agent, or Firm*—Cassidy, Vance & Tarleton

[57] ABSTRACT

Target bubble generating and target shooting systems (50, 50A, 50B, 50C) are disclosed employing a target bubble generator housing (59), a pair of left and right actuating handles (51, 55) pivotally coupled at their front ends of the left and right vertical edges of the housing (59), and a bellows assembly (116) positioned intermediate the left and right handles (51, 55) and coupled to the latter at the approximate midpoints thereof. The target bubble generating housing (59) includes a torus-shaped reservoir (81) and a vertically reciprocable bubble wand (98) having a film-forming elliptical ring structure (101) including upper and lower serrated arcuate edges (102, 104) of truncated triangular cross section to minmize disturbance of the soapy fluid in the reservoir (81) as the bubble wand (98) exits the fluid. The bellows assembly (116) generates three positive pressure airstreams during compression—one to lift the wand (98) out of the film-forming solution, one to strip the soapy film from the wand (98) to form and project target bubbles (60), and one to actuate an audible sound generator (127). During expansion, the bellows assembly (116) creates a negative pressure condition which serves to affirmatively retract the bubble wand (98). The twin actuating handles (51, 52) which are manually manipulated to compress and expand the bellows (58) serve as water ejectors capable of projecting one or two high pressure water stream (61) along parallel, convergent or divergent trajectories to enable shooting down target bubbles (60).

35 Claims, 17 Drawing Sheets

Fig. 14
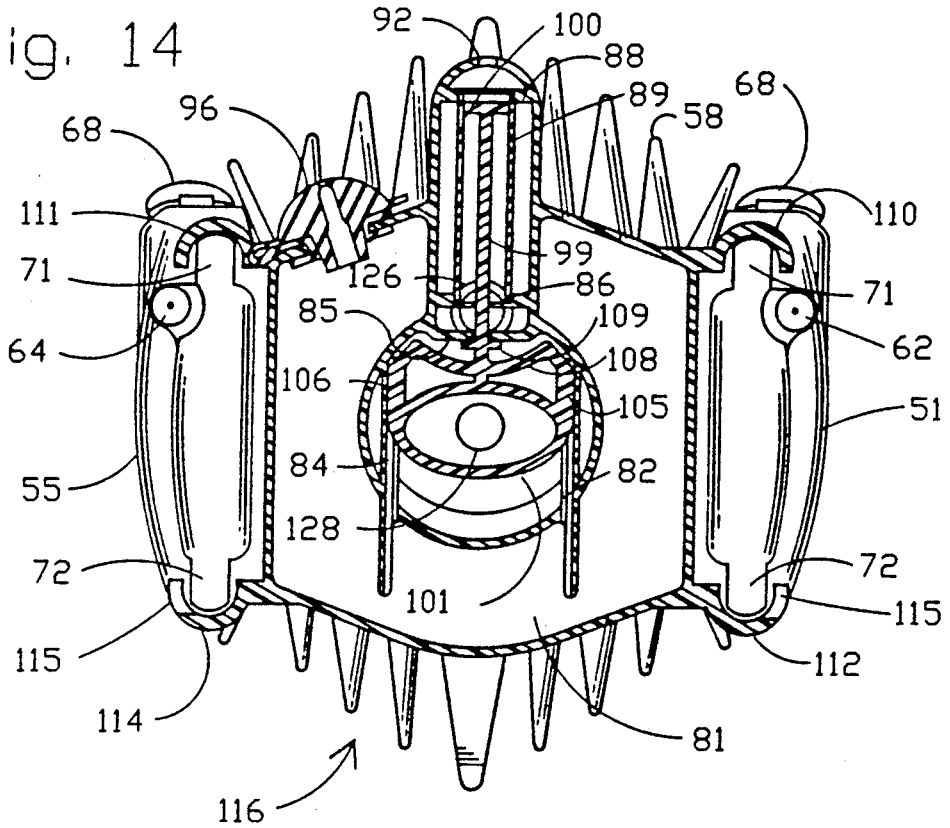
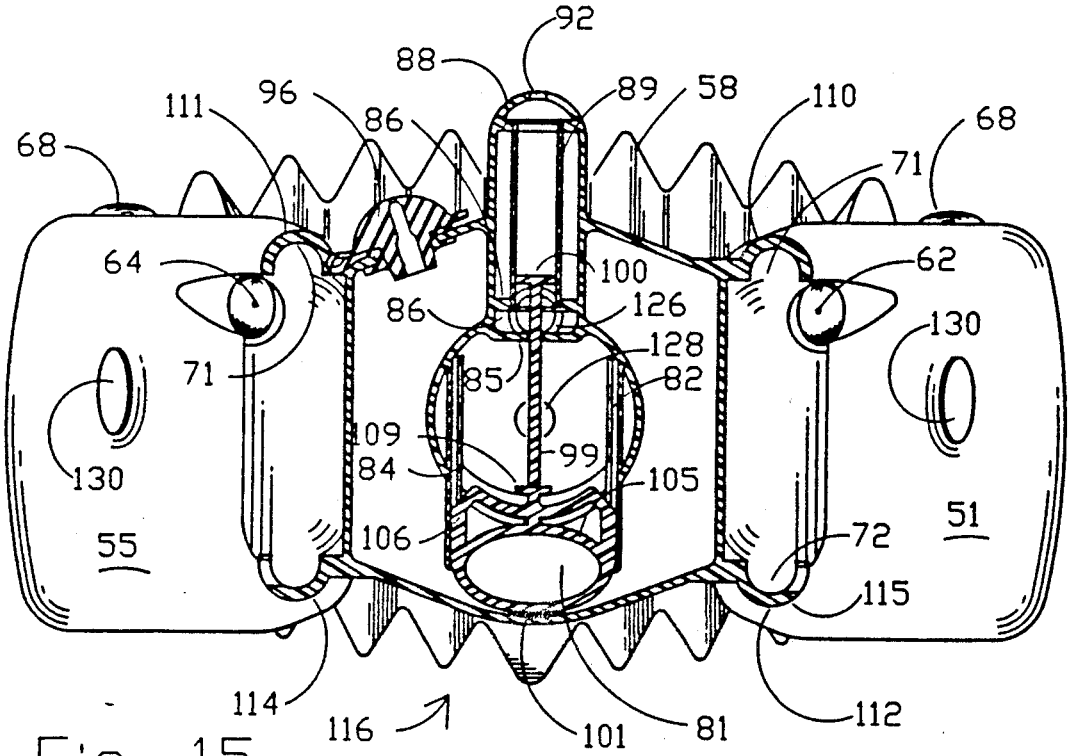
Fig. 15

TARGET BUBBLE GENERATION AND TARGET SHOOTING SYSTEM

BACKGROUND OF THE INVENTION

1. Technical Field

The present invention relates generally to bubble generating games, amusement devices, and methods of operation thereof; and, more particularly, to an improved amusement device and method of use thereof which are usable by young and old alike, and which are suitable for generating soap bubbles which then serve as targets for projected water streams shot from, and generated by, the same toy that generated the soap bubbles in the first instance.

More specifically, the present invention relates to simple, yet highly effective methods and apparatus for generating separate, independent, pressurized air streams, one of which serves to positively raise and lower a dip ring or bubble-blowing wand from and into a reservoir containing a soapy film-forming solution, another of which serves to project an air stream axially through the bubble blowing wand when the latter is raised out of the reservoir for generating and projecting bubbles therefrom, and yet another of which serves to release excess pressure while permitting replenishment of expelled air, all using at least one bellows for generating: (i) a first positive pressure air stream to raise the bubble blowing wand out of the reservoir and to project an air stream at and through the raised wand; (ii) a second negative pressure air stream for either returning or assisting in the return of the wand to the reservoir after the soapy film formed thereon has been stripped therefrom in the bubble generating operation; (iii) a third air stream, totally separate and independent from the first and second positive and negative pressure air streams, for stripping the soapy film from the raised wand to generate and project one or more bubbles during the bellows compression stroke and for permitting replenishment of the air supply in the bellows during the expansion stroke; and (iv), a fourth air stream comprising an air regulation stream which may, if desired, be associated with a sound producing device, such as a whistle, for allowing release of excess air in the bellows during the compression stroke, which excess air might otherwise break the soap film on the wand, and for permitting replenishment of the air supply in the bellows during the expansion stroke.

The present invention further comprises a manually operated bellows arrangement for a bubble generating system wherein the actuating handles for the bellows comprise a pair of manually operable water ejection nozzles and wherein the actuating handles are physically connected intermediate their ends to opposite sides of the bellows and pivotally connected at their forward ends to opposite sides of the bubble generating housing and reservoir for the soapy film-forming solution so as to enable the user to direct either single water streams or twin water streams from one or both of the twin water ejection nozzles at bubbles generated by the user's toy or by another's toy; and, when twin water streams are ejected, such streams can be controllably directed at the target(s) along parallel, convergent and/or divergent trajectories.

In another of its principal aspects, the present invention is directed to an improved dip ring or bubble blowing wand which, because of its configuration, is able to be moved through, and out of, a body of soapy film-forming solution with only minimal displacement of the fluid body, thereby minimizing the danger of premature stripping of the soapy film from the wand.

2. Background Art

The prior art is replete with literally dozens of published and/or patented toys, games and similar amusement devices dating back over the past five (5) decades relating to the generation of bubbles. Representative patents include, merely by way of example, U.S. Pat. No. 2,301,427 Lyon, Jr. which discloses a bubble forming device having a valve responsive to the pressure of air introduced therethrough by blowing into the valve such that at relatively low pressure an air stream is blown into and through a cup containing a soapy liquid or bubble forming solution so as to form a bubble at the top of the cup, whereupon the child or other user must blow harder to shift the valve and direct a blown air stream around the cup to separate the formed bubble therefrom.

Limber U.S. Pat. No. 2,560,582 is representative of a number of available prior art patents disclosing a "bubble gun" comprising: (i) a reservoir for a soapy liquid or bubble-forming solution; (ii) a bubble blowing wand movable, generally vertically, into and out of the solution in the reservoir; (iii) a linkage for shifting the wand into and out of the reservoir upon physical movement of a trigger or the like; and (iv), a system for blowing an air stream through the wand when raised out of the reservoir so as to cause the soapy film formed thereon to form a bubble which is blown off the wand and out of the muzzle of the toy gun. Somewhat similar disclosures are found in U.S. Pat. Nos.: 2,393,039 Gilchrist, Jr.; 2,518,627 Lorenz; 2,553,388 Steiner et al.; 2,599,888 Beezley et al.; 2,700,845 Arliss; 2,802,298 Larin; 2,828,579 Schwerbel et al.; 2,942,374 Mann; 2,974,438 Hopkins; 3,389,492 Sullivan et al.; 3,398,479 Rave; and, 3,733,736 Glessner, Sr.

N.A. Greene, in U.S. Pat. No. 2,853,829 and its Canadian counterpart—viz., Canadian Pat. No. 620,504 issued May 23, 1961—describes a caricature-like toy having a vertically reciprocable head mounted in a squeeze bottle with freedom for vertical movement relative thereto as the bottle is squeezed. The vertically reciprocable head includes a bubble blowing wand or dip ring which, when the bottle is expanded and the head retracted, resides in a reservoir of soapy bubble forming liquid; but, when the bottle is squeezed to raise the head, the head serves to lift the wand out of the reservoir and into close proximity to an air ejection nozzle coupled to the interior of the squeeze bottle. Greene discloses a somewhat similar arrangement in a later issued patent—viz., U.S. Pat. No. 3,093,925. In this instance, however, Greene employs a bellows which, when compressed, serves to open the jaw of an animal's caricature head while simultaneously lifting the bubble blowing wand coupled to the upper jaw out of a reservoir in the lower jaw and placing the film covered wand adjacent a nozzle located at the juncture of the upper and lower jaws and coupled directly to the bellows so as to project an air stream through the wand and cause bubbles to be blown out of the open jaws. Somewhat similar disclosures are found in U.S. Pat. Nos. 3,579,898 Hein; 3,736,694 Lebensfeld; and, 3,775,898 Kalish.

U.S. Pat. No. 3,388,498, also issued to N. A. Greene, discloses a bubble making toy wherein a reservoir of soapy liquid is mounted on the upper end of a pressurized gas cannister. Movement of the reservoir downwardly by the user serves to expose a bubble-blowing wand aligned with a gas discharge nozzle and, at the same time, to actuate the pressurized gas cannister so as to project an aspirated air/gas mixture through the wand to form bubbles. When the reservoir is released and permitted to move upwardly, it moves into surrounding relation with the bubble forming wand while the discharge nozzle of the pressurized gas cannister is closed.

In 1975, U.S. Pat. No. 3,925,923 was issued to John E. LaFata, the inventor herein named, and John D. Cuccio. Such patent discloses a simulated, pump-actuated, shotgun-type toy having a torus-shaped reservoir disposed within the toy's muzzle and a bubble blowing wand mounted within the torus-shaped reservoir and coupled to an air-actuated piston for shifting the wand from the torus-shaped reservoir containing the soapy bubble forming solution to a point lying generally centrally of the torus and on the axis thereof such that an air stream passing axially outward through the toy's muzzle is directed axially through the torus and the raised wand so as to form bubbles and project them out of the toy gun's muzzle. Air to move the actuating piston coupled to the wand and to project the bubbles therefrom is generated by relative expansion and contraction of a pair of pump-actuated telescopic barrel members of the toy gun.

In general, devices such as those described above—particularly those disclosed in the aforementioned LaFata et al. U.S. Pat. No. 3,925,923, the various Greene Patents, and the Lyon, Jr. Patent, all of which employ an air actuated piston and/or valve arrangement—have suffered from some continuing and rather severe problems. Not only are the actuating mechanisms complex but, additionally, the arrangements are such that when the devices are recharged with air following a bubble forming operation, there is a tendency to draw some of the unused soapy bubble solution back into the relatively movable parts, tending to gum up the devices and render them substantially inoperable, particularly by young children, until subsequently dismantled, cleaned and reassembled. Indeed, these problems were especially prevalent in the toy disclosed in the aforesaid LaFata et al. U.S. Pat. No. 3,925,923 where the air conduits were below the upper level of the fluid solution, thus promoting aspiration of the soapy solution into the working parts of the toy.

Moreover, the very complexity of these devices have prevented their use for the dual purpose of: (i) generating soap bubbles which can be used as targets; and ii), acting as integral water pistols capable of shooting down the bubble targets generated either by the shooter's toy or by an opponent's toy. However, two (2) such toys are known to the present inventor and have been disclosed in U.S. Pat. Nos. 3,399,485 Cashavelly et al. and 4,334,383 Melotti. Thus, Cashavelly et al. disclose a combined water gun and bubble forming toy where the toy gun's nozzle has a laterally directed aperture such that when dipped into a soapy bubble forming solution, a film is formed enabling the child to wave the gun with the air movement through the laterally directed film-covered aperture forming bubbles which can then serve as targets for the toy which serves the dual function of a conventional water pistol. Melotti discloses a somewhat similar toy pistol employing a reservoir of soapy bubble solution and a bubble wand which, when raised out of the pistol in the vicinity of what would normally be the pistol's rear sight, enables the child to blow through the wand to generate a bubble which can then be shot at by what appears to be a conventional water pistol.

Both Cashavelly et al. and Melotti, as well as many of the other aforementioned prior patents, are further somewhat disadvantageous since they have been designed to simulate relatively realistic looking conventional weapons; and, as a consequence, many parents are extremely reluctant to permit use of such toys by their children.

Other patents known to the present inventor which are believed to be of generally miscellaneous interest include Canadian Patent No. 487,366 Scott [a bubble forming device including a bubble blowing wand and a mechanical linkage for raising the wand from a reservoir into alignment with an air nozzle and subsequently lowering the wand into the reservoir] and U.S. Pat. Nos.: 2,514,009 Raspet [a bubble wand formed of twisted wire]; 2,858,639 Lawrence [a container for a soapy bubble forming solution having a vertically movable element containing multiple bubble forming apertures]; 2,987,847 Jones [an impellor driven disk with bubble-forming apertures and an orifice permitting the user to blow into the device to drive the impellor and to blow through the apertures as the disk rotates]; 2,989,818 Filger et al. [a bubble blowing toy simulating a musical instrument]; 3,060,626 Panico, Jr. [an apparatus and method for forming a bubble on a supporting pad and then blowing the bubble off of the pad]; 4,125,959 Markiw [a device having a reciprocable bubble blowing wand and a system for blowing air through the film-covered wand when raised to its upper position]; and, 4,556,392 Chang [a bubble blowing self-propelled octopus].

SUMMARY OF THE INVENTION

The present invention overcomes all of the disadvantages inherent in the known prior art by providing a simple, safe, durable, nonviolent water amusement toy or device, which is devoid of metal parts and essentially devoid of moving parts except for a reciprocating, air-actuated, piston-driven bubble wand and actuating arms for a bellows; and, more specifically, a toy or amusement device of the foregoing type which is formed entirely of plastic and/or blow molded plastic parts and is, therefore, essentially impervious to rust and/or corrosion, which does not require batteries, which is shatterproof and essentially spill resistant, and which is capable of generating at least three (3) separate and independent positive pressurized air streams upon compression of the bellows—viz., (i) one stream to shift the piston coupled to the bubble wand and lift the wand vertically out of a torus-shaped reservoir in a plane containing the vertical axis passing through the piston; (ii) a second controlled pressurized air stream directed through the center of the torus-shaped reservoir and axially through the raised film covered wand to generate the bubbles; and (iii), a third excess air relief stream which serves to release excess pressurized air during compression of the bellows which might otherwise break the soapy film on the wand, which third relief stream may be associated with a sound-producing device such as a whistle—while creating a negative air pressure upon expansion of the bellows to retract the piston and return the wand to a position where it is immersed in the soapy bubble-forming solution in the torus-shaped reservoir and simultaneously permitting replenishment of the air supply in the bellows during expansion thereof.

At the same time, the two (2) handles which are used to compress and expand the bellows serve as manually operable, hand-held, twin ejection nozzles for directing one (1) or, if desired, two (2) high pressure water streams along one of a single path, parallel paths, convergent paths and/or divergent paths so as to enable the user to employ the bubbles generated by his/her toy and/or by another's toy as targets to be shot down by the controlled high pressure water stream(s).

The system of the present invention is highly desirable in that it not only permits easy, reliable generation of bubbles to be used as targets but, additionally, it permits shooting down the target bubbles with either or both of twin ejection nozzles; yet, wherein the system gives the overall appearance of some type of nonviolent high technology device bearing virtually no aesthetic similarity to guns, pistols or similar arms.

To this end, it is a general aim of the present invention to provide a target bubble generating system consisting essentially of molded plastic parts which readily permit usage by persons of virtually any age, but especially pre-teen children, to easily form and project bubbles which can then be used as targets for a pair of twin, manually operated, water ejection nozzles which can be aimed along parallel, divergent and/or convergent paths and actuated either singly or in unison, yet wherein the resulting amusement device bears virtually no similarity to conventional weaponry.

It is a more specific object of the invention to provide a target bubble generating system of the foregoing character wherein at least one enclosed expandable/contractible air chamber such, merely by way of example, as a bellows, is used to generate at least three (3) separate and completely independent positive pressure air streams upon compression of the bellows or other air chamber—viz., (i) one air stream fed via a first conduit to actuate a piston so as to shift a bubble wand out of a torus-shaped reservoir containing a bubble forming solution and into axial alignment with an air nozzle; (ii) a second controlled air stream directed through the air nozzle and axially through the aligned centers of the torus-shaped reservoir and the raised bubble wand so as to form one or more bubbles from the film of bubble forming solution on the wand; and (iii), a third excess air relief stream which may be used to actuate a whistle or other audible sound generator—and, for forming a negative pressure state in the first conduit upon expansion of the bellows so as to affirmatively shift the piston coupled to the bubble wand in the opposite direction and to return the bubble wand to a position immersed within the bubble forming solution in the torus-shaped reservoir, while reversing the flow of the second controlled air stream and the third excess air relief stream during expansion of the bellows so as to permit replenishment of the air therein which serves as a motive fluid during compression of the bellows.

In one of its more detailed aspects, it is an object of the present invention to provide a bellows operated bubble generator for forming target bubbles wherein the actuating arms for the bellows serve the dual functions of bellows actuating arms and individually aimable water ejection nozzles.

A still further and more detailed objective of the present invention is the provision of an improved bubble blowing wand configuration which enables the wand to move through and out of the reservoir of soapy fluid with only minimal disturbance of the fluid, thereby minimizing the danger of spillage of the soapy fluid as the wand exits from the reservoir.

Yet another object of the present invention is to provide a toy or amusement device of the foregoing character which not only employs minimal moving parts but, moreover, is entirely devoid of metal fasteners, springs, actuating linkages, batteries and similar components normally found in devices of this character.

In another of its important aspects, it is an object of the invention to provide an improved valve assembly for use with amusement devices and the like, such valve assembly including a suction inlet, a high pressure outlet, and a syringe-type resilient compressible/expandable actuating bulb.

DESCRIPTION OF THE DRAWINGS

These and other objects and advantages of the present invention will become more readily apparent upon reading the following Detailed Description and upon reference to the attached drawings, in which:

FIG. 14 is a vertical sectional view taken substantially along the line 14—14 in FIG. 10 and here depicting the relative positions of the components, including particularly the bubble forming wand, during a bellows compression stroke;

FIG. 15 is a vertical sectional view similar to that shown in FIG. 14, but here taken substantially along the line 15—15 in FIG. 9 and depicting the relative positions of the components during an expansion stroke of the bellows where the negative pressure created serves to retract the wand and immerse it in the bubble forming solution (not shown) contained within the reservoir;

Figure 1:
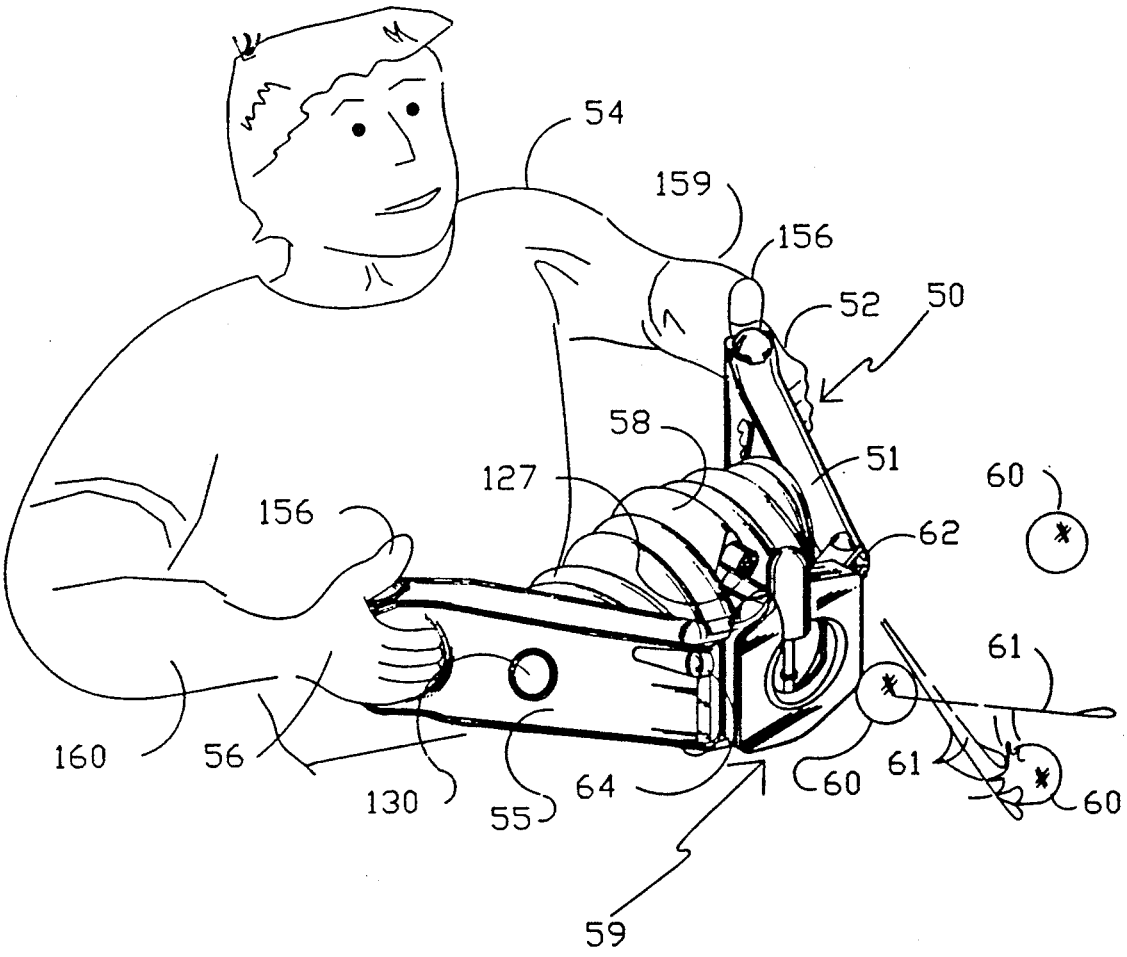
FIG. 1 is a somewhat diagrammatic isometric view here depicting an individual using an amusement device embodying features of the present invention to generate bubbles usable as targets and to then shoot such target bubbles down employing manually operable water ejection nozzles incorporated in the amusement device.

While the invention is susceptible of various modifications and alternative forms, specific embodiments thereof have been shown by way of example in the drawings and will herein be described in detail. It should be understood, however, that it is not intended to limit the invention to the particular forms disclosed; but, on the contrary, the intention is to cover all modifications, equivalents and alternatives falling within the spirit and scope of the invention as expressed in the appended claims.

DETAILED DESCRIPTION

A. General Organization of Components

(1) Overall Toy 50

Turning now to the drawings, and directing attention first to FIG. 1, an amusement device or non-violent water toy embodying features of the present invention and comprising a target bubble generating and target shooting system, generally indicated at 50, has been illustrated during usage thereof. Thus, as here shown, the system 50 comprises a target bubble generating and target shooting toy having: (i) a left actuating handle 51 grasped in the left hand 52 of a user 54; (ii) a right actuating handle 5 grasped in the right hand 56 of the user 54; (iii) an enclosed expandable/compressible air chamber which here takes the form of a bellows 58 coupled at its opposite ends to the approximate mid-points of respective ones of the left and right actuating handles 51, 55; and (iv), a target bubble generating housing, generally indicated at 59, pivotally connected along its opposite vertical edges to the forward-most ends of the left and right actuating handles 51, 55 in a manner hereinafter described in greater detail.

In usage of the exemplary target bubble generating and shooting system 50, the user 54 merely moves his/her left and right hands 52, 56 towards one another so as to compress the intermediate bellows 58—it being understood that as the user 54 moves the actuating handles 51, 55 inwardly adjacent their rearmost ends, the forward ends thereof pivot about parallel spaced vertical axes adjacent the left and right vertical edges of the target bubble generating housing 59 to which they are pivotally connected. Compression of the bellows 58 serves to generate one or more target bubbles 60 in a manner to be described hereinafter in greater detail. Once the user 54 has generated one or more target bubbles 60, the user can then depress suitable actuators or triggers (not shown in FIG. 1) associated with the hand grips of one or both of the left and right actuating handles 51, 55 so as to eject one (1) or two (2) pressurized water streams 61 through water ejection nozzle 62, 64 formed in respective ones of the left and right actuating handles 51, 55 along one or more trajectories aimed at given target bubbles 60 in an effort to "shoot down" the bubbles. Of course, those skilled in the art will appreciate that when the user moves his left and right hands 52, 56 outwardly or away from one another, such action causes the left and right actuating handles 51, 55 to pivot outwardly away from one another about their points of pivotal connection to the left and right vertical edges of the target bubble generating housing 59. Therefore, the system 50 comprises a directionally controllable system wherein the user 54 can shift the left and right actuating handles 51, 55 at will to direct twin pressurized water streams 61 from the ejection nozzles 62, 64 along converging intersecting paths as shown in FIG. 1 or, if desired, along parallel or diverging paths (not shown).

Figure 2:
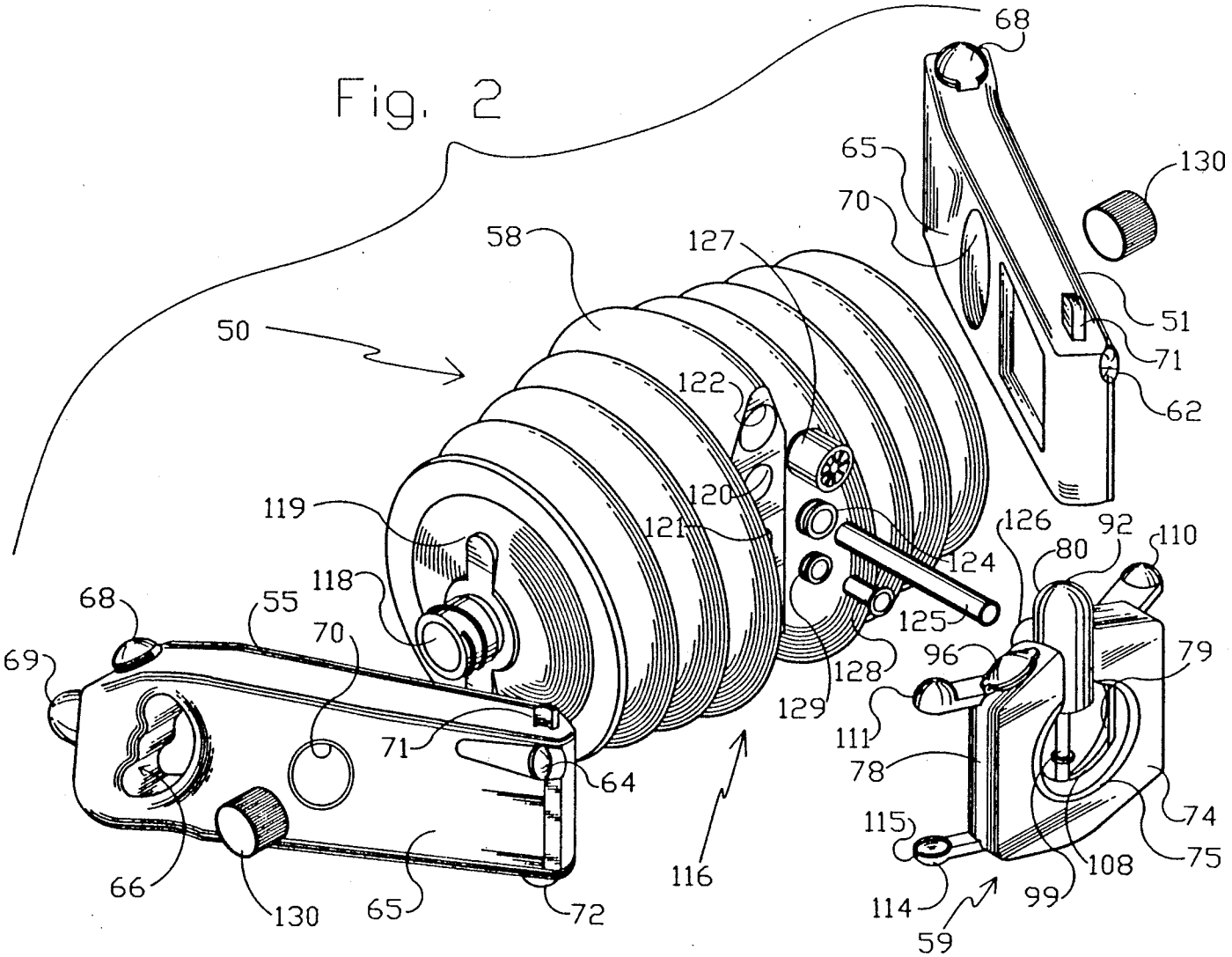
FIG. 2 is a partially exploded isometric view here illustrating the basic subassemblies used with the amusement device of the present invention in partially disassembled form.

Referring next to FIG. 2, the foregoing basic components of the illustrative toy 50 are illustrated, and will herein be described, in somewhat greater detail. Thus, as here shown, it will be noted that the exemplary right actuating handle 55 comprises a hollow enclosed housing 65 blow molded from any suitable plastic material and provided with: (i) a hand grip, generally indicated at 66; (ii) a fill port having a closure element 68 enabling the housing 65 to be at least partially filled with water; (iii) a water ejection nozzle 64 (nozzle 62 in the case of the left-actuating handle 51); (iv) a palm-actuated trigger or actuator 69 suitable for ejecting water from the interior of the housing 65 through the ejection nozzle 64 (through nozzle 62 in handle 51); (v) a through transverse aperture 70 at the approximate midpoint of the housing 65; (vi) an upwardly projecting locking lug 71 at the upper front end of the housing 65; and (vii), a downwardly projecting locking lug 72 at the lower front end of the housing 65 (with the two locking lugs 71, 72 being vertically aligned). It will, of course, be understood by those skilled in the art that the left actuating handle 51 is constructed in precisely the same way as described above for the right actuating handle 55, comprising a mirror image thereof.

(2) Target Bubble Generating Housing 59

As best illustrated by reference to FIGS. 2 and 6 conjointly, it will be observed that the target bubble generating housing 59 includes: (i) a forward housing element 74 having a through central opening 75 and an upper vertical housing extension 76; and (ii), a mating complemental rear housing element 78 having a similar through central opening 79 and a similar complemental upstanding vertical housing extension 80. The forward and rear housing elements 74, 78 are adapted to be permanently bonded together in edge-to-edge abutting relation by use of any suitable adhesive or plastic bonding technique to define a substantially enclosed, torus-shaped reservoir, generally indicated at 81, suitable for containing a supply of soapy, bubble forming solution (not shown). The complementally shaped front and rear housing elements 74, 78 are each provided with facing, complemental, spaced, parallel, vertical track-defining means 82, 84 and a series of horizontally disposed, vertically spaced, complemental, mating, semi-cylindrical flanges 85, 86, 88. While the foregoing track-defining means 82, 84 and flanges 85, 86, 88 are visible in FIG. 6 only on the inner portion of the rear housing element 78, it will be understood by those skilled in the art that the inner portion of the front housing element 74 which is not visible in FIG. 6, will include complementally shaped track-defining means and semi-cylindrical flanges.

Thus, the arrangement is such that when the front and rear housing elements 74, 78 are assembled, an upstanding, vertically-oriented, cylinder 89 is fixedly secured between the mating semi-cylindrical flanges 86, 88. Moreover, the uppermost edges of the upwardly extending vertical housing extensions 76, 80 are respectively provided with small, complementally shaped, semi-circular openings 90, 91 which, upon assembly of the components together, define a relief port 92 as best shown in FIG. 2. At the same time, the front and rear housing elements 74, 78 are each provided along their upper edges with complemental, mating, semi-circular openings 94, 95 adapted to define a fill port closable by means of a snap-in closable closure element 96. Finally, the exemplary target bubble generating housing 59 serves to movably retain a dip ring or bubble forming wand, generally indicated at 98 in FIG. 6, having an integral, vertically upstanding, piston rod 99 terminating at its uppermost end in a piston head 100 dimensioned to be slidably received within cylinder 89 with the bubble forming wand 98 positioned between the front and rear housing elements 74, 78, and with piston rod 99 extending into, and the piston head 100 being slidably received within, the cylinder 89.

(3) Bubble Blowing Wand 58

Figure 7:
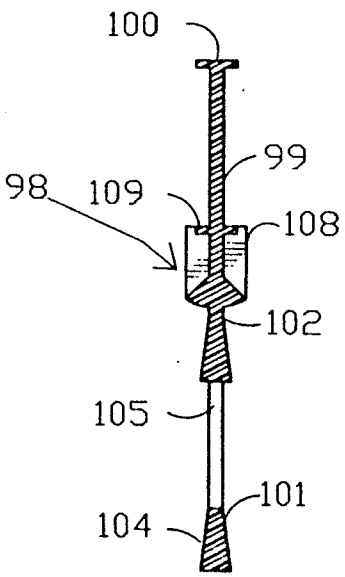
FIG. 7 is a fragmentary vertical sectional view taken substantially along the line 7—7 in FIG. 6 and here depicting structural details of the exemplary bubble forming wand.

In keeping with one of the important aspects of the present invention, the exemplary bubble blowing wand 98 is provided with a generally oval or elliptical ring structure 101 having upper and lower serrated edges 102, 104 which, as best shown in FIG. 7, are of generally truncated, triangular, cross-sectional shape so as to enable the elliptically shaped ring structure 101 to knife through the soapy bubble forming solution in reservoir 81 during upward movement of the wand 98 through the solution and withdrawal of the wand 98 from the solution, thereby minimizing disturbance of the solution as the wand 98 moves upwardly through, and out of, the fluid so as to minimize the danger of spillage of the soapy fluid in the reservoir 81 as the serrated elliptical ring structure 101 exits the fluid. Moreover, as is well known to persons skilled in the art, the provision of serrated edges 102, 104 on the ring structure 101 serves to ensure that an adequate supply of soapy film-forming solution is picked up by, and retained as a film on, the bubble wand 98.

Further in keeping with this aspect of the present invention, the dip ring or bubble forming wand 98 includes a pair of vertically oriented, laterally spaced, guide rails 105, 106 adapted to be slidably retained captive within respective ones of the track-defining means 82, 84 formed on the front and rear housing elements 74, 78. Further, the illustrative bubble forming wand 98 includes a forward and rearward extending arcuate flange 108 extending between the spaced apart vertical upright guide rails 105, 106 immediately above the upper serrated edge 102 of the elliptical ring structure 107, which flange serves to substantially close a complemental arcuate gap (not shown in the drawings) that is formed between the front and rear housing elements 74, 78 when assembled (which gap permits insertion of the wand 98 into, and removal thereof from, the soapy film-forming solution in reservoir 81) when the wand 98 is in its lowermost position with the elliptical ring structure 101 disposed within the fluid, thereby minimizing spillage. Finally, the wand 98 includes a radial flange 109 formed adjacent the lower end of piston rod 99, which flange serves as a stop element engagable with the mating undersides of the semi-cylindrical flanges 85 on each of the housing elements 74, 78 to limit upward vertical movement of the wand 98 so as to precisely align the center of the elliptical ring structure 101 on a horizontal axis passing through the complemental openings 75, 79 in respective ones of the front and rear housing elements 74, 78.

To permit assembly of the target bubble generating housing 59 to the left and right actuating handles 51, 55 with freedom for pivotal movement with respect thereto, the rear housing element 78 is provided with a first pair of upper, laterally extending, slightly rearwardly flared, semi-spherical, inverted, cup-shaped lug receptacles 110, 111 and a second pair of lower, laterally extending, slightly rearwardly flared, semi-spherical, cup-shaped lug receptacles 112, 114. In the exemplary device, the lower cup-shaped lug receptacles 112, 114 are provided with oppositely directed slots 115 for a purpose to be described below in conjunction with the description of FIGS. 3A-3C through 5A-5C.

(4) Bellows Assembly 116

In carrying out the present invention, the exemplary bellows assembly, generally indicated at 116 in FIG. 2, includes a bellows 58 formed of blow molded plastic material and having a pair of axially extending, oppositely directed, externally threaded, stub mounting shafts 118—it being understood that only the right stub mounting shaft 118 is visible in the drawing. The opposite ends of the bellows are further provided with a key 119 adapted to fit into a complementally shaped keyway slot 119*a* (FIG. 16) formed in the inner walls of the left and right actuating handle housings 65 so as to prevent relative rotation therebetween and to insure that the bellows assembly and its associated air inlet/outlet ports, described below, are precisely located with respect to the target bubble generating housing 59.

Figure 8:
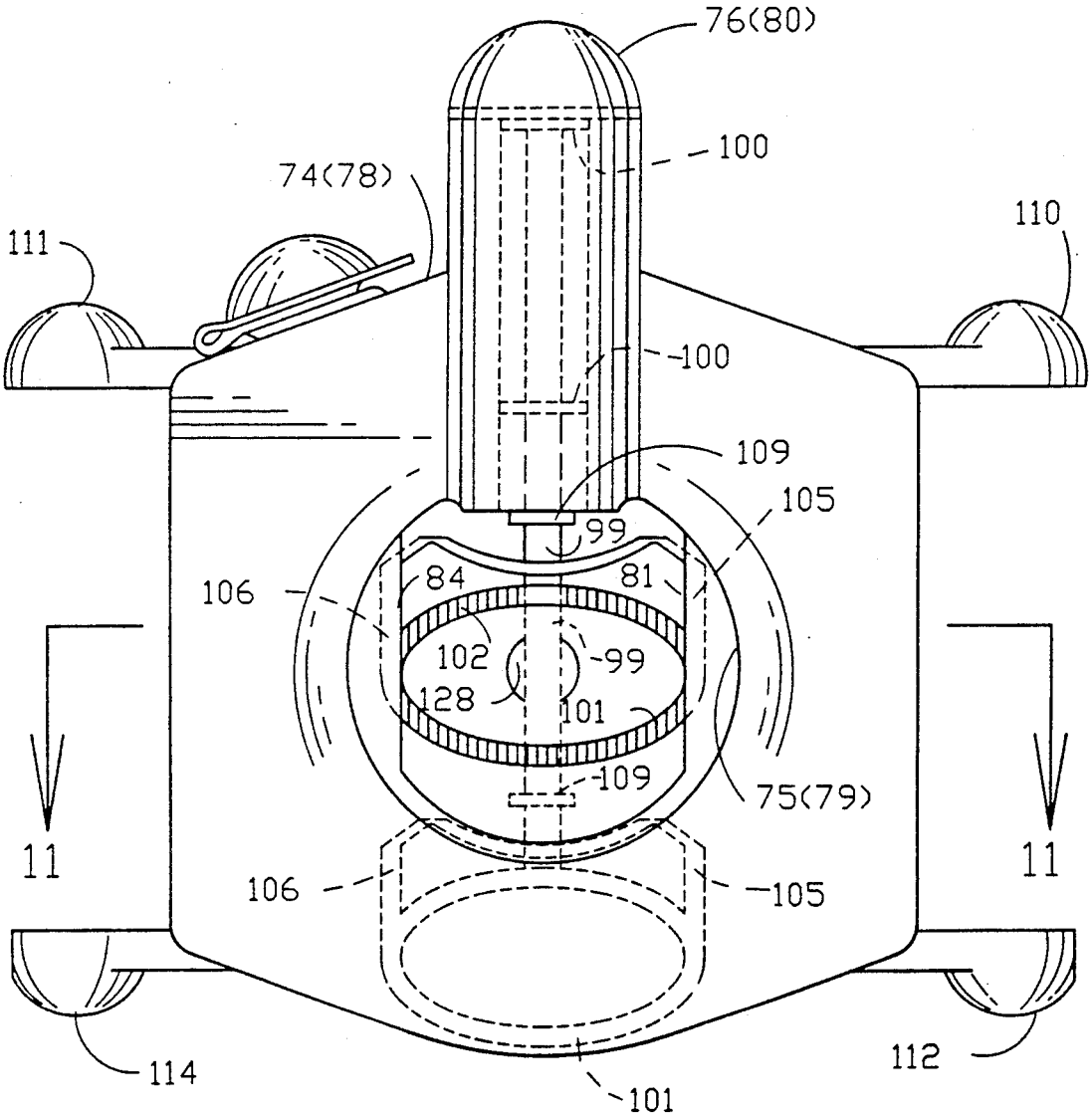
FIG. 8 is a front elevational view of the target bubble generating housing used with the present invention, here depicting the bubble forming wand in solid lines in its raised position and in broken lines in its lowered position within the bubble forming solution maintained in the torus-shaped reservoir.

To permit pneumatic operation of the target bubble generating and target shooting system 50, the bellows 58 is provided with three (3) inlet/outlet ports 120, 121, 122. In the exemplary device, port 120 is provided with a rubber grommet 124 which serves to mount one end of a cylindrical tube 125, the opposite end of which is snugly received within a rearwardly extending cylindrical stub shaft 126 (best shown in FIGS. 6 and 9) integrally formed with the upstanding vertical housing extension 80 formed on the rear housing element 78 of the target bubble generating housing 59. Thus, the arrangement provides a source of positive motive fluid during a compression stroke of the bellows 58 which can be used to shift the piston/piston head combination 99/100 upwardly to withdraw the bubble wand 98 from the torus-shaped reservoir 81 and center it within the aligned openings 75, 79 in the housing 59 as shown in solid lines in FIG. 8. And, of course, those skilled in the art will appreciate that during an expansion stroke of the bellows 58, a negative pressure condition is created in tube 125 so as to affirmatively retract the piston/piston head combination 99/100 and thus return the bubble wand 98 to the broken line position in the torus shaped reservoir 81 as shown in FIG. 8.

In order to separate the soapy film formed on the elliptical ring structure 101 of the bubble wand 98 when the latter is raised out of the torus-shaped reservoir 81 so as to form target bubbles 60 (FIG. 1), outlet port 121 in bellows 58 is coupled to an air discharge nozzle 128 by means of a second rubber grommet 129. Thus, during a compression stroke of bellows 58, a pressurized air stream is directed out of nozzle 128 and axially through the aligned opening 75, 79 in the target bubble generating housing 59; and, since the bubble wand 98 is then raised out of the torus-shaped reservoir 81 with its elliptical ring structure 101 centered within such aligned opening 75, 79 in housing 59 as shown in solid lines in FIG. 8, such pressurized air stream is directed axially through the elliptical ring structure 101 and serves to strip the soapy film formed thereon from the ring structure, producing target bubbles 60 which are projected from the toy 50 by distances on the order of up to five feet (5') or more, thereby creating one or more target bubbles 60 which the user 53 can attempt to shoot down with one or two streams 61 of pressurized water as best shown in FIG. 1. During an expansion stroke of the bellows 58, air discharge nozzle 128 permits reverse air movement therethrough, thus permitting replenishment of the air supply within the bellows 58.

In the exemplary device 50, any suitable sound generating device such, for example, as a whistle 127 can be snap-fit into the air inlet/outlet port 122 in bellows 58. Such an arrangement provides three (3) desired functions. First, during a compression stroke of the bellows 58, excess air is expelled outwardly through port 122 and whistle 127, causing a desired audio sound effect. Secondly, since excess air is permitted to escape from the bellows through port 122 and whistle 127, the amount of air discharged through discharge nozzle 128 is regulated, thereby minimizing the danger of so disrupting the film formed on the bubble wand 98 as to preclude production of bubbles. Finally, during an expansion stroke of the bellows, air is permitted to move in the reverse direction through the whistle 127 and port 122 so as to assist in replenishing the air supply within the bellows 58.

(5) Assembly

Figure 6:
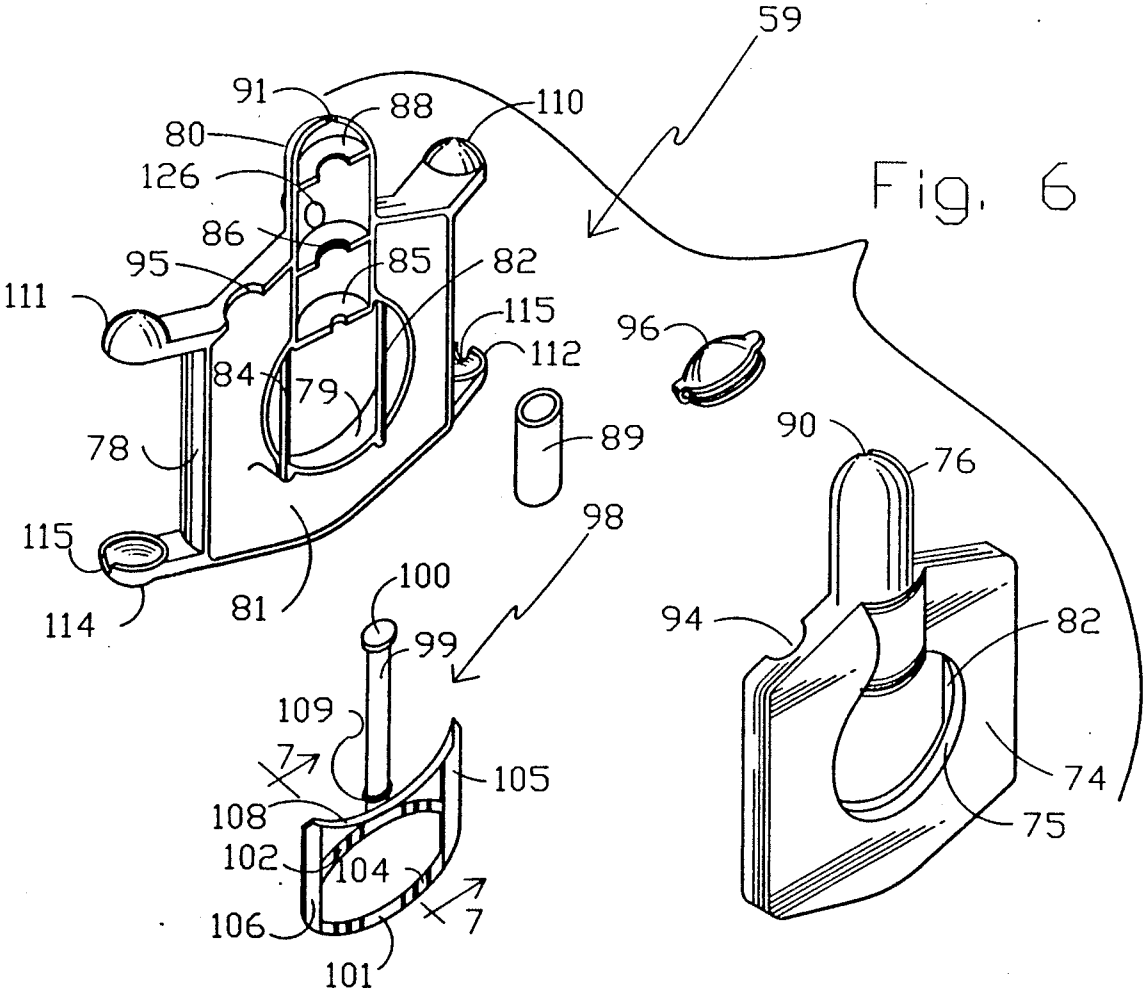
FIG. 6 is an exploded isometric view illustrating details of the components defining the target bubble generating housing including a torus-shaped reservoir and a bubble forming wand.

In order to assemble the toy 50, and as best shown by initial reference to FIG. 6, the piston/piston head combination 99/100 of the bubble wand 98 are inserted into cylinder 89 which is then seated between the semi-cylindrical flanges 86, 88 in the front and rear housing elements 75, 78 with cylinder 89 being bottomed on the semi-cylindrical flanges 85. The front and rear housing elements 75, 78 are then placed in edge-to-edge abutting relation and permanently bonded together using any suitable plastic adhesive or plastic bonding technique to produce the unitary target bubble generating housing 59 depicted in FIG. 2 having only a single movable part—viz., the bubble wand 98 which is free to reciprocate up and down dependent upon which side of the piston head 100 mounted within cylinder 89 is subjected to positive pressure.

As ensuing assembly steps, the grommet 129 and air discharge nozzle 128 are mounted in the air inlet/outlet port 121; the whistle 127 is snap-mounted in the air inlet/outlet port 122; and, the grommet 124 and tube 125 are mounted in air inlet/outlet port 120, with the opposite or free end of the tube 125 being snugly mounted within the cylindrical stub shaft 126 integral with the upstanding vertical housing extension 80 on the rear housing element 78 of the target bubble generating housing 59.

Figure 3A:
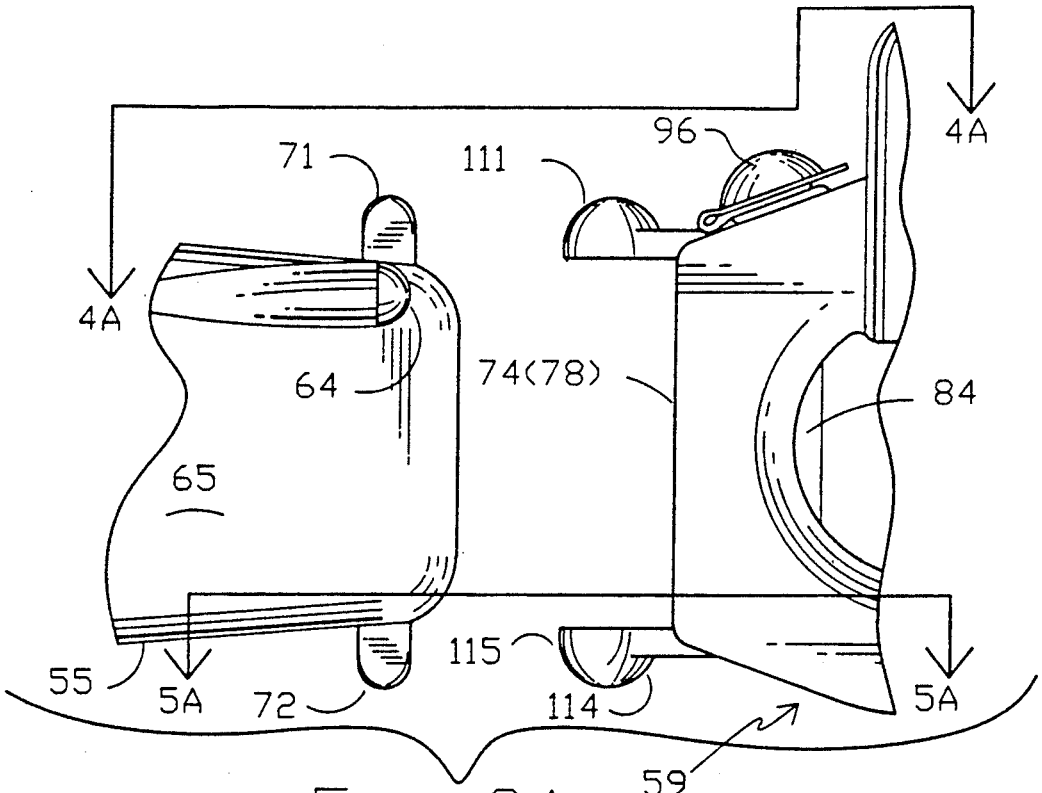
FIG. 3A is a fragmentary front elevational view here illustrating one of the two bellows actuating arms, which also serve as water ejection nozzles, in readiness for insertion into mounting lug receptacles formed on the side of the torus-shaped reservoir preparatory to assembling these components together.
Figure 4A:
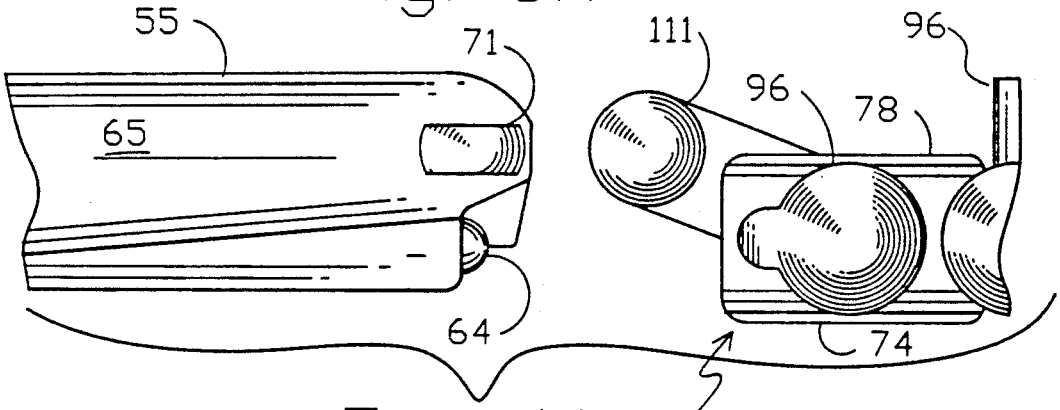
FIGS. 4A and 5A are fragmentary, somewhat diagrammatic, top plan views taken substantially along respective ones of the lines 4A—4A and 5A—5A in FIG. 3A.
Figure 5A:
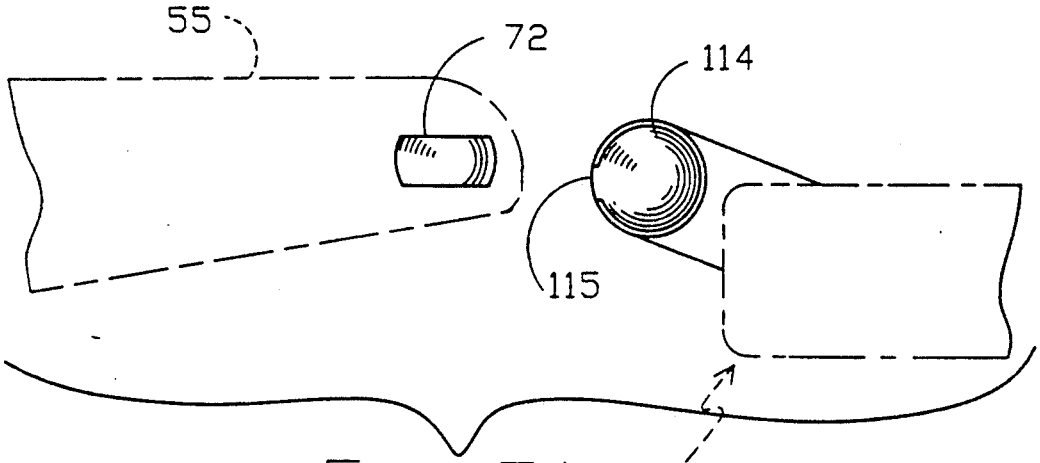
Figure 3B:
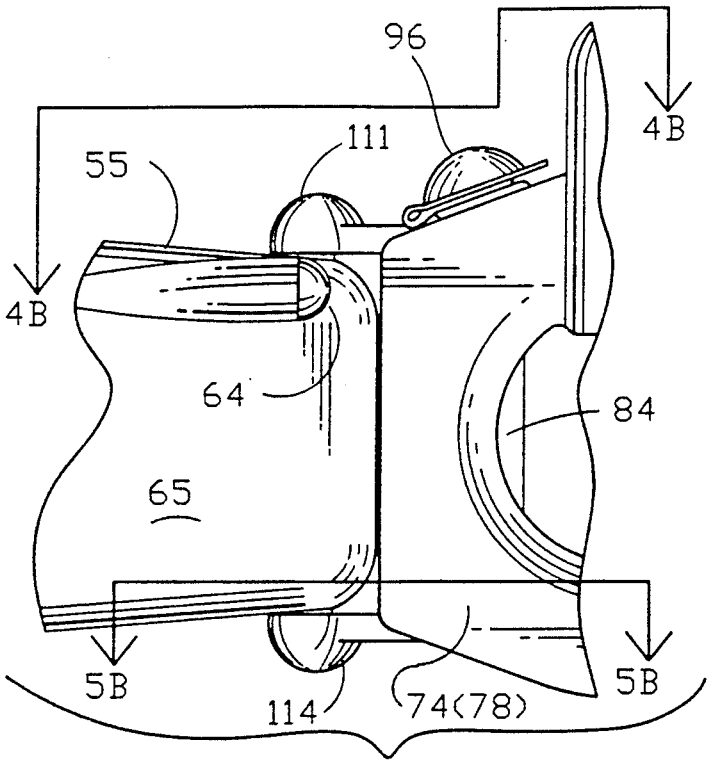
FIG. 3B is a fragmentary front elevational view illustrating the bellows actuating arm inserted into the mounting lug receptacles on the torus-shaped reservoir.
Figure 4B:
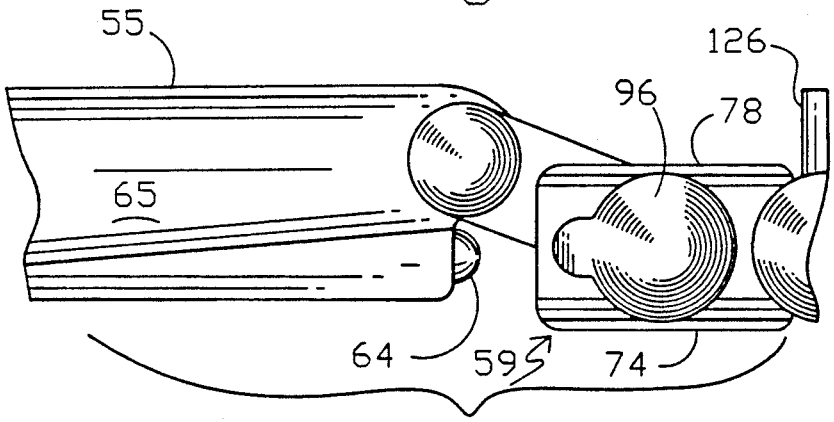
FIGS. 4B and 5B are fragmentary, somewhat diagrammatic, top plan views taken substantially along respective ones of the lines 4B—4B and 5B—5B in FIG. 3B.
Figure 5B:
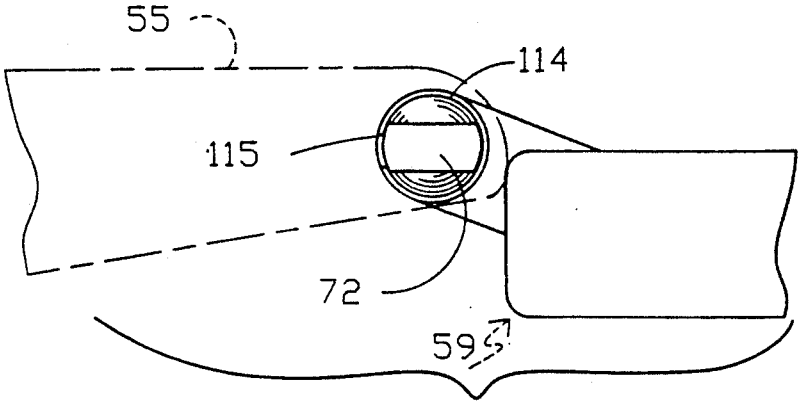
Figure 3C:
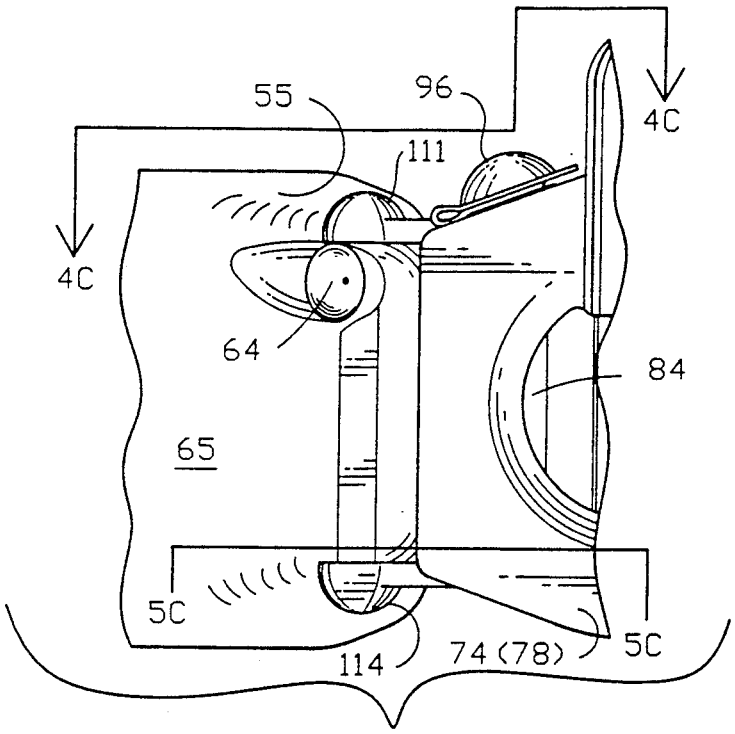
FIG. 3C is a fragmentary front elevational view illustrating one of the bellows actuating arms fully assembled and locked into position with respect to the torus-shaped reservoir in pivotal relation therewith.
Figure 4C:
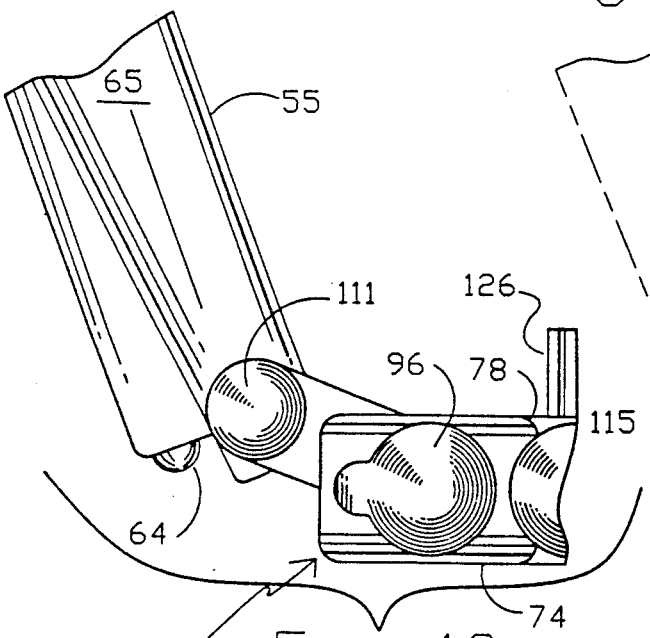
FIGS. 4C and 5C are fragmentary, somewhat diagrammatic, top plan views taken substantially along respective ones of the lines 4C—4C and 5C—5C in FIG. 3C.
Figure 5C:
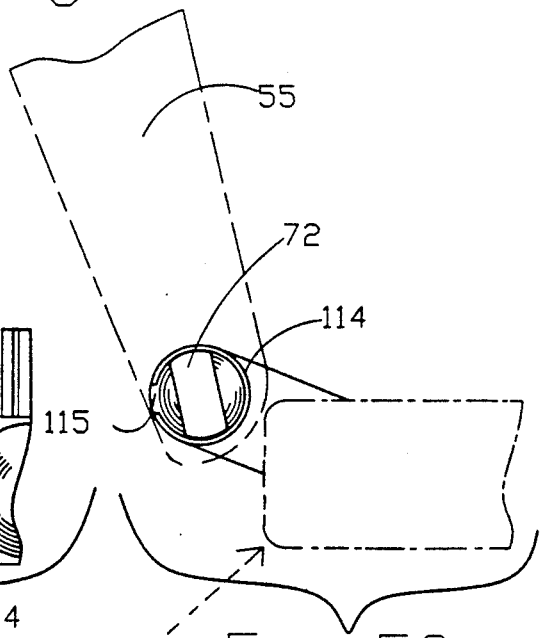

Turning now to FIGS. 3A-3C through 5A-5C, and directing attention first to FIGS. 3A, 4A and 5A on Sheet 3 of the drawings, the manner of assembly of the right actuating handle 55 to the target bubble generating housing 59 and the bellow assembly 116 will be described.

Initially, and as shown in FIGS. 3A-5A, the right actuating handle 55 is positioned in the same plane containing the target bubble generating housing 59 and, more specifically, the plane containing the upper and lower lug receptacles 111 and 114 formed on and projecting out of the right side thereof. The right housing 65 is then cocked slightly (not shown) so as to permit the assembler to move the housing 65 to the right as viewed in FIG. 3A, thus permitting the upper mounting lug 71 on housing 65 to be inserted into the upper, inverted, semi-spherical, cup-shaped lug receptacle 111 on housing 59. At this point, the lower mounting lug 72 on housing 65 is moved to the right as viewed in FIG. 3A through the slot 115 in the lower, semi-spherical, cup-shaped lug receptacle 114 with the components then occupying the positions shown in FIGS. 3B-5B on Sheet 4 of the drawings. Thereafter, the right housing 65 is rotated in a clockwise direction as viewed in FIG. 3B from the position there shown to that shown in FIGS. 3C–5C on Sheet 5 of the drawings, thus securely locking the parts together due to capture of the mounting lugs 71, 72 within the upper and lower facing cup-shaped lug receptacles 111, 114, while leaving the right actuating handle 55 free to pivot about a vertical axis passing through the lug receptacles 111, 114 on the right side of the target bubble generating housing 59. Those skilled in the art will appreciate that the left actuating handle 51 and its upper and lower mounting lugs 71, 72 are mounted in the left lug receptacles 110, 112 (FIG. 6) on the left side of the target bubble generating housing 59 in precisely the same manner, with the left housing 65 being rotated in a counterclockwise direction to securely couple the two components together with freedom for relative pivotal movement therebetween about a vertical axis passing through the left lug receptacles 110, 112.

In order to finish assembly of the toy 50, the left and right actuating handles 51, 55 are moved towards one another so as to permit the left and right externally threaded stub shafts 118 (See, FIG. 2 where only the right stub shaft 118 is visible) on the bellows 58 to enter into the central through apertures 70 formed in the left and right housings 65. Thereafter, left and right internally threaded screw caps 130—each having an external diameter dimensioned to permit the screw cap 130 to extend into the aperture 70 but which precludes the screw cap 130 from passing axially through the aperture 70—are threaded onto the externally threaded stub shafts 118 so as to lock the entire assembly together.

The user is now able to move the left and right actuating handles 51, 55 towards one another to compress the bellows and thus expel positive pressure air streams simultaneously through: (i) air inlet/outlet port 120 to raise the bubble wand 98 out of the torus-shaped reservoir 81: (ii) air inlet/outlet port 121 to direct a pressurized air stream axially through the film covered elliptical ring structure 101 on the raised bubble wand 98 so as to strip the film therefrom and produce one or more target bubbles 60 as shown in FIG. 1; and (iii), air inlet/-outlet 122 to blow the whistle 127. Conversely, when the user 54 moves the left and right actuating handles 51, 55 away from one another, the bellows 58 is expanded, creating a negative pressure in tube 125 to affirmatively retract the bubble wand 98 and return the elliptical ring structure 101 to the torus-shaped reservoir 81; while, at the same time, permitting replenishment of the air supply and restoration of atmospheric pressure conditions within the bellows 58 via air inlet ports 121, 122.

B. Operation of Target Bubble Generator and Target Shooting System 50

Having in mind the foregoing general organization of structural components, the overall operation of the exemplary target bubble generating and target shooting system 50 will now be described in greater detail with reference to FIGS. 9 through 15. More specifically, it will be observed upon inspection and comparison of FIGS. 9 and 10 that the amusement device 50 has been depicted in FIG. 9 with the left and right actuating handles 51, 55 shifted away from one another and with the bellows 58 in an expanded state—i.e., in readiness to form and project target bubbles 60 (FIG. 1)—whereas in FIG. 10 the amusement device has been depicted with the left and right actuating handles 51, 55 essentially parallel to one another and with the bellows 58 compressed—i.e., following generation and projection of target bubbles 60 (FIG. 1) and in readiness to actuate one or both of the water ejectors to direct one or two high pressure water streams 61 (FIG. 1) at the floating bubbles 60. Of course, as illustrated in FIG. 10, were two high pressure water streams 61 to be ejected from the left and right ejection nozzles 62, 64, such streams would be projected along parallel trajectories. However, as will be understood from the foregoing description, the user 54 (FIG. 1) could, if desired, move the left and right actuating handles 51, 55 even closer together, further compressing the bellows 58, to enable projection of two high pressure water streams 61 along divergent trajectories or, alternatively, the user 54 could move the handles 51, 55 away from one another, either partially or fully expanding the bellows 58, so as to enable projection of two high pressure water streams 61 along converging trajectories as shown in FIG. 1, intersecting at virtually any desired point from immediately in front of the toy 50 to distances up to on the order of approximately twenty-five feet (25') in front of the toy.

The ensuing description will first proceed with reference to FIGS. 10, 11, 12 and 14 conjointly where the operation of the exemplary amusement device 50 during a compression stroke of the bellows assembly 116 will be described. Thereafter, the description will proceed with reference to FIGS. 9, 11, 13 and ;5 conjointly where the operation of the exemplary amusement device 50 during an expansion stroke of the bellows assembly 116 will be described.

1. Compression Cycle

Referring first to FIGS. 10, 11, 12 and 14 conjointly, the various structural components of the non-violent water toy 50 have been illustrated in the relative positions occupied during a compression cycle of the bellows assembly 116—i.e., during that period of time when the user 54 (FIG. 1) is closing the actuating handles 51, 55 relative to one another and prior to the time when full compression of the bellows 58 occurs. During this period, air is expelled from the interior of the bellows 58 which is being compressed to cause the following three (3) separate actions to occur simultaneously.

Figure 11:
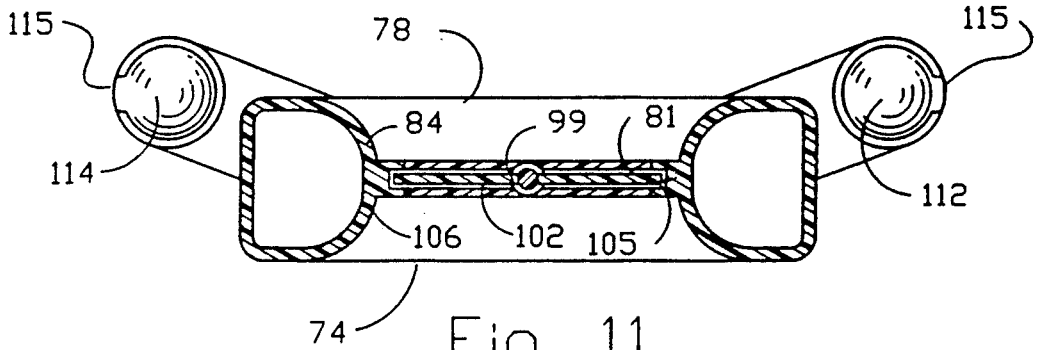
FIG. 11 is a sectional view taken substantially along the line 11—11 in FIG. 8, here depicting details of the torus-shaped reservoir and bubble forming wand.

Firstly, positive pressure is exerted on the underside of piston head 100 which is slidably positioned within cylinder 89 in the target bubble generating housing 59 so as to shift the piston/piston head combination 99/100 of the bubble wand 98 upwardly, withdrawing the film-covered elliptical ring structure 101 bubble wand 98 from the torus-shaped reservoir 81 and centering the ring structure 101 between the aligned openings 75, 79 and on a common horizontal axis (assuming the toy 50 is oriented in a horizontal plane) with the axis passing through the air discharge nozzle 128 in bellows 58. Such upward movement of the piston/piston head combination 99/100 is permitted because the air in the upper end of cylinder 89 is vented through the relief port 92; and, when the radial stop 109 on the piston 99 bottoms on the lower surface of the mating semi-cylindrical flanges 85, the bubble wand 98 is precisely located in the desired position. As shown in FIG. 11, as the bubble wand 98 moves upwardly, the guide rails 105, 106 slide upwardly within respective ones of the track-defining means 81, 84.

Secondly, a high pressure air stream is ejected through the air discharge nozzle 128 and axially through the film-covered elliptical ring structure 101 of the bubble wand 98, thus serving to strip the soapy film from the serrated elliptical ring structure 101 to form one or more target bubbles—e.g., the bubble 60 shown in FIG. 1—which are projected axially out of, and away from, the target bubble generating housing 59 by the air stream exiting nozzle 128.

Thirdly, a positive air stream is ejected through the whistle 130, causing a desirable audible sound; and, at the same time, releasing excess air so as to regulate the air stream exiting discharge nozzle 128.

Those skilled in the art will appreciate that when the bellows 58 is fully compressed, the air streams exiting therefrom and passing through tube 125, discharge nozzle 128 and whistle 127 will terminate, thus allowing the bubble wand 98 to drop back into the torus-shaped reservoir 81 under the influence of gravity, pressure on opposite sides of the piston head 100 being equalized by virtue of the vent hole 92—assuming, of course, that the user 54 is holding the toy in a generally horizontal attitude. If, however, the user 54 has turned the toy 50 vertically or substantially vertically, gravity will not necessarily cause retraction of the bubble wand 98 to its lowermost position; but, as will be described below in connection with the expansion stroke of the bellows 58, when gravity is ineffective to return the bubble wand 98 to its lowermost position, the negative pressure which occurs in tube 125 during expansion of the bellows 58 serves to affirmatively retract the bubble wand 58.

2. Expansion Cycle

Figure 9:
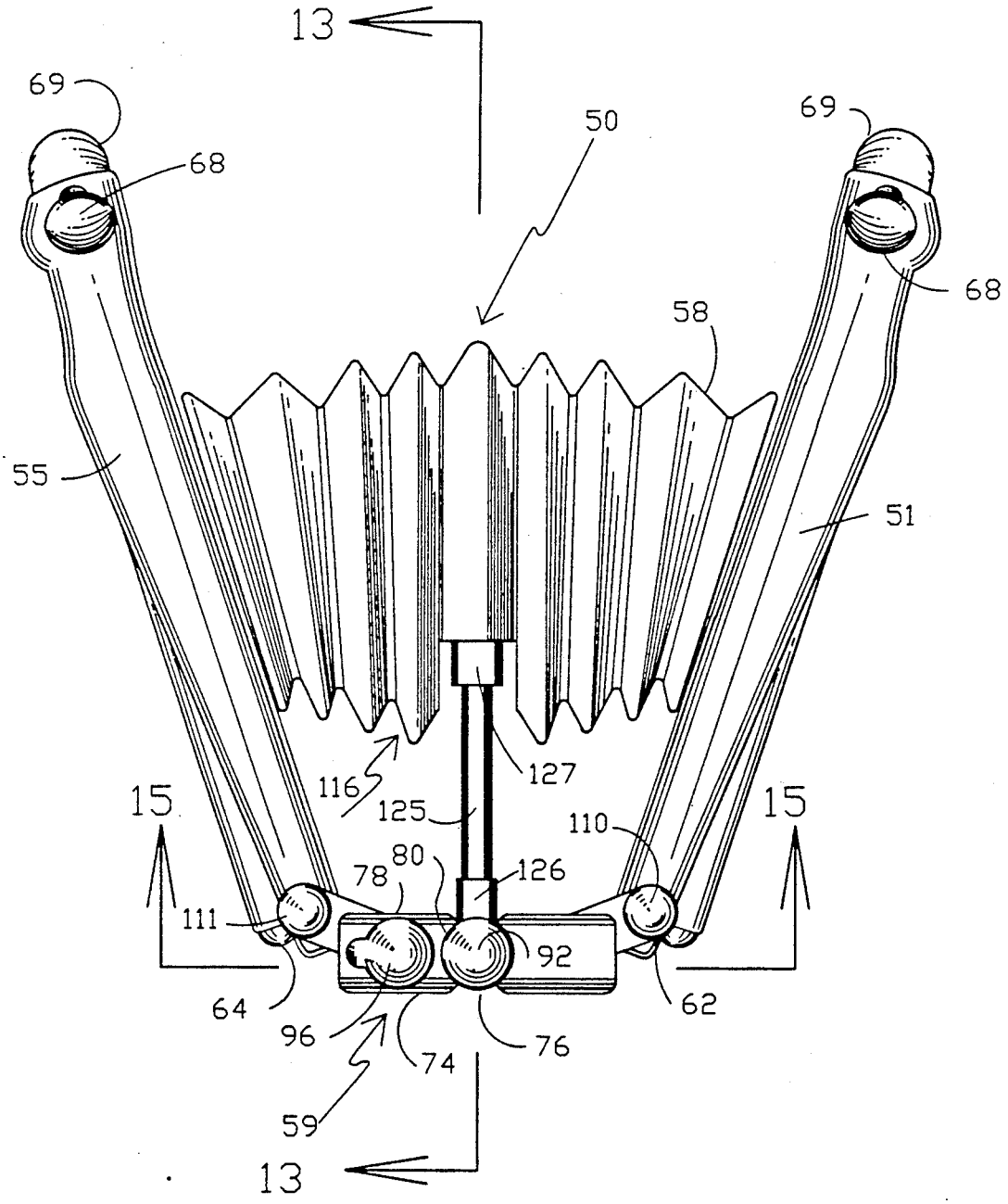
FIG. 9 is a top plan view of the amusement device of the present invention here depicting the bellows actuating arms in their outermost positions with the bellows fully expanded so as to create a negative pressure state causing the bubble forming wand to be retracted into its lowered position within the reservoir.
Figure 10:
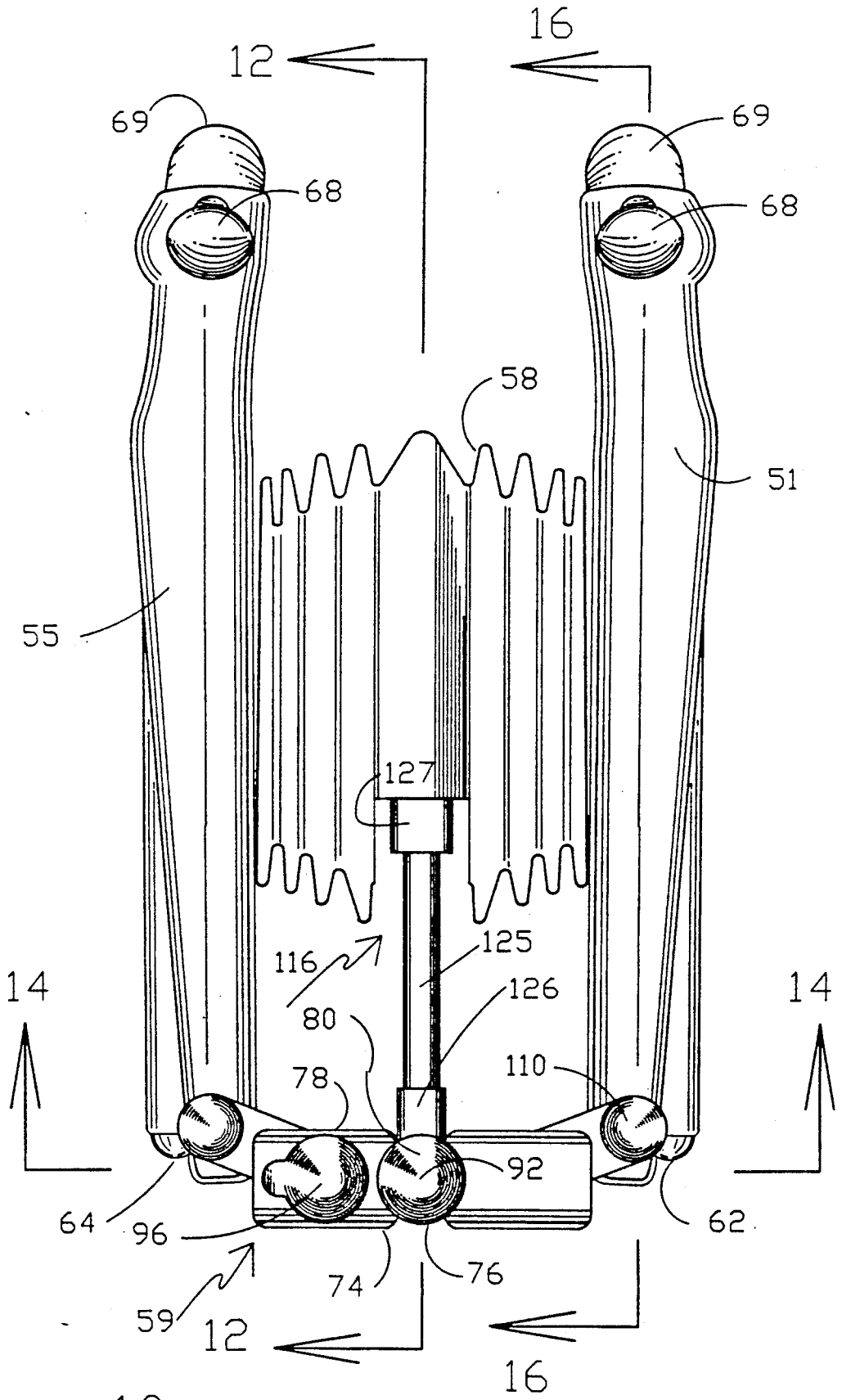
FIG. 10 is a top plan view similar to FIG. 9 but here illustrating the amusement device with the bellows actuating arms in inward positions and with the bellows compressed at the end of a bubble generating cycle.

Considering next FIGS. 9, 11, 13 and 15 conjointly, it will be apparent to those skilled in the art that as the user 54 (FIG. 1) shifts the left and right actuating handles 51, 55 away from one another—i.e., from the position shown in FIG. 10 toward that shown in FIG. 9—the bellows 58 is expanded, thereby momentarily creating a partial vacuum therein so as to create a negative pressure condition. Such partial vacuum or negative pressure is communicated via tube 125 to cylinder 89 in the target bubble generating housing 59, creating a pressure differential on opposite sides of the piston head 100—i.e., a lesser or negative pressure below the piston head 100 and positive or atmospheric pressure above the piston head 100 due to the presence of vent 92. Such pressure differential serves to assist gravity return of the bubble wand 98 from the raised position shown in FIG. 14 to the lowered position shown in FIG. 15 where the serrated elliptical ring structure 101 is again disposed in the soapy fluid solution (not shown) maintained in the torus-shaped reservoir 81. And, of course, in those instances where gravity is not effective to assist in lowering the bubble wand 98 due to the attitude of the amusement device 50, such pressure differential serves to affirmatively retract the bubble wand 98.

At the same time—i.e., during the expansion stroke of the bellows 58—the partial vacuum momentarily created within the bellows 58 causes a pressure differential across both the discharge nozzle 128 and the audible sound generator or whistle 127—viz., positive or atmospheric pressure existing externally of the nozzle 128 and whistle 127, while a negative pressure condition exists on the interior of the bellows 58, thus causing a reverse flow of air therethrough to replenish the air supply within the bellows 58 and return the pressure therein to atmospheric.

C. Water Ejection System 131

Figure 17:
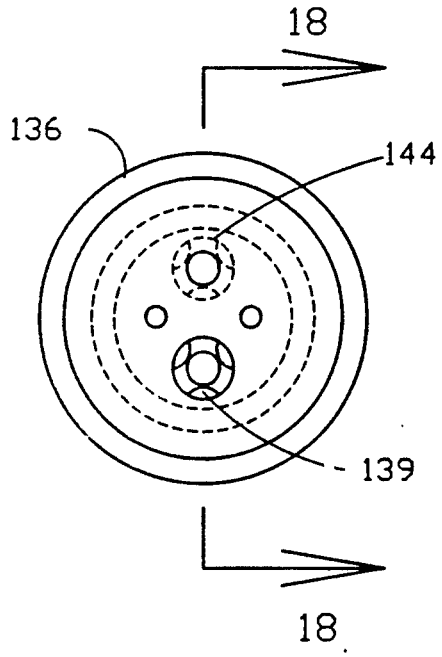
FIG. 17, which appears on Sheet 10 of the drawings, is a rear elevational view of the exemplary push-bulb valve used in the water ejection system depicted in FIG. 16.
Figure 18:
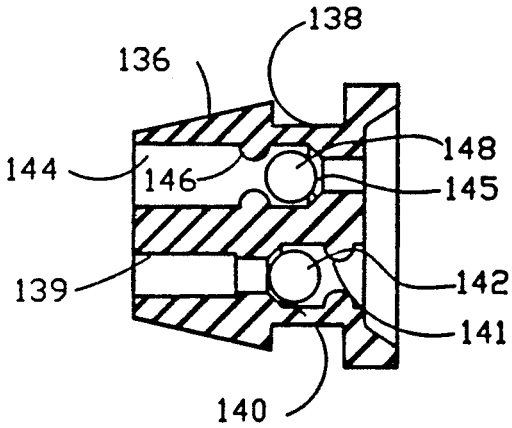
FIG. 18, which appears on Sheet 10 of the drawings, is a vertical sectional view taken substantially along the line 18—18 in FIG. 17.
Figure 12:
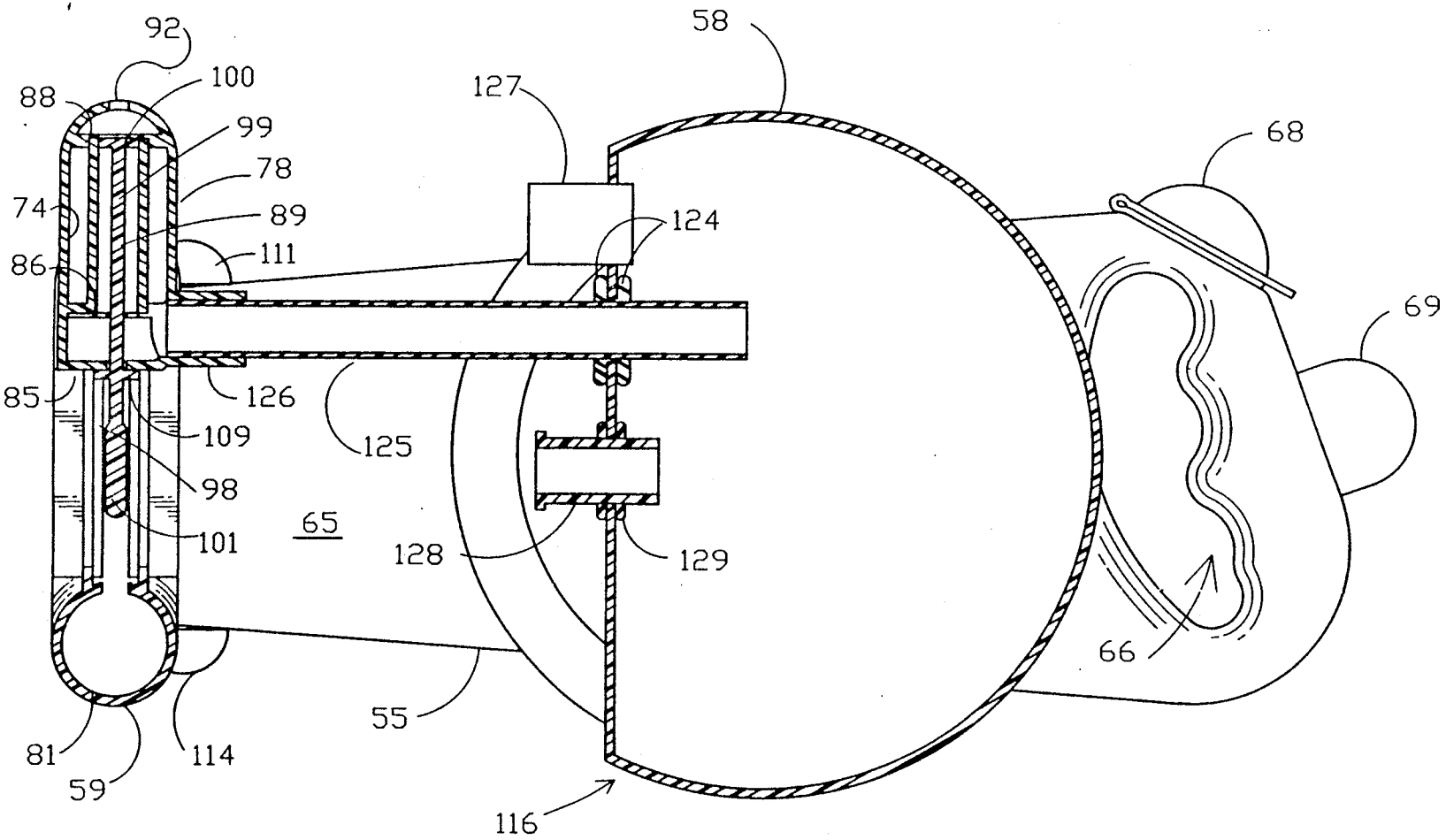
FIG. 12 is a sectional view taken substantially along the line 12—12 in FIG. 10, here depicting the relative positions of the components, including especially the bubble forming wand, during compression of the bellows.
Figure 13:
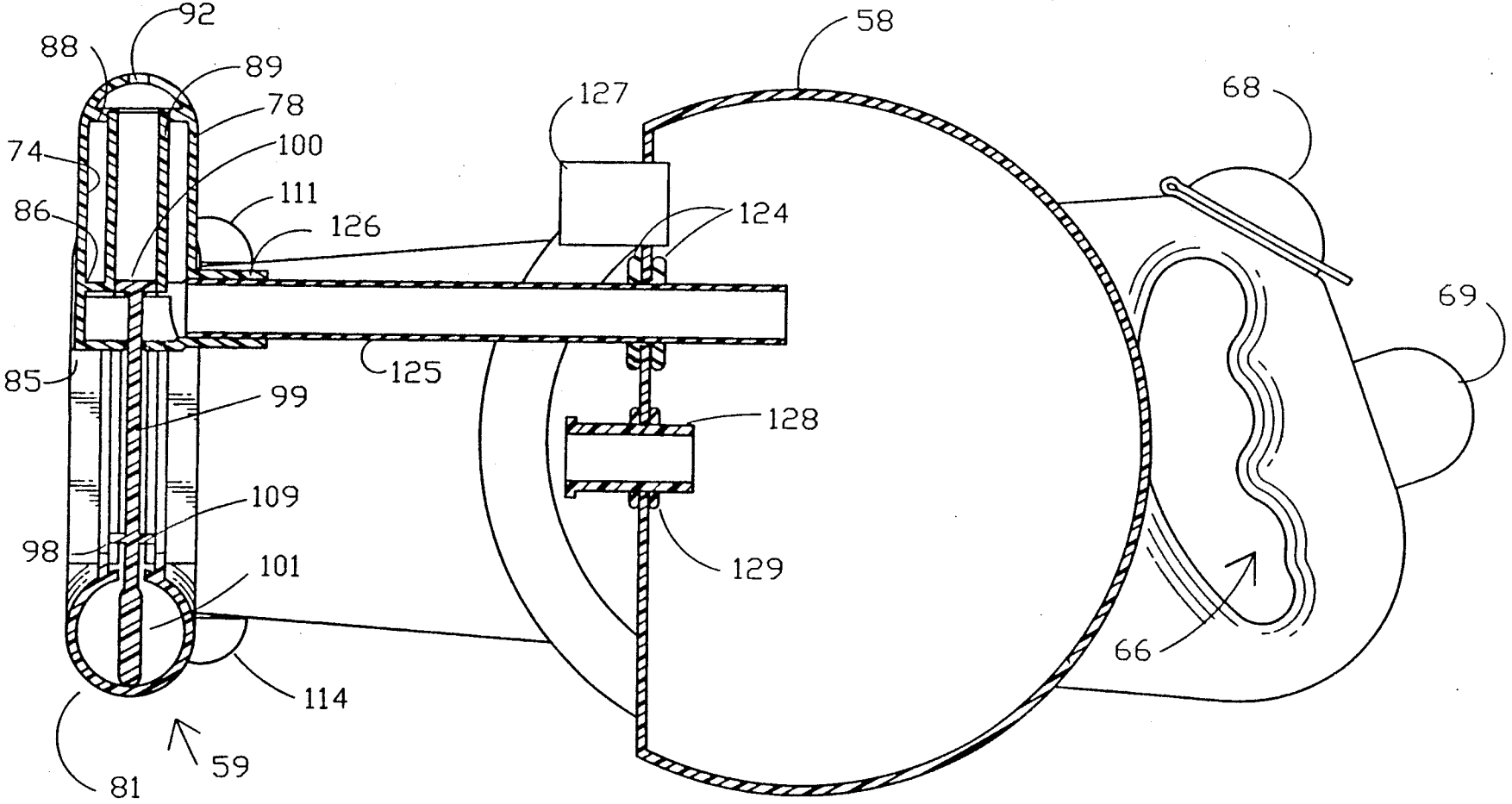
FIG. 13 is a sectional view similar to that shown in FIG. 12, here taken substantially along the line 13—13 in FIG. 9, and depicting the relative positions of the components during expansion of the bellows.
Figure 16:
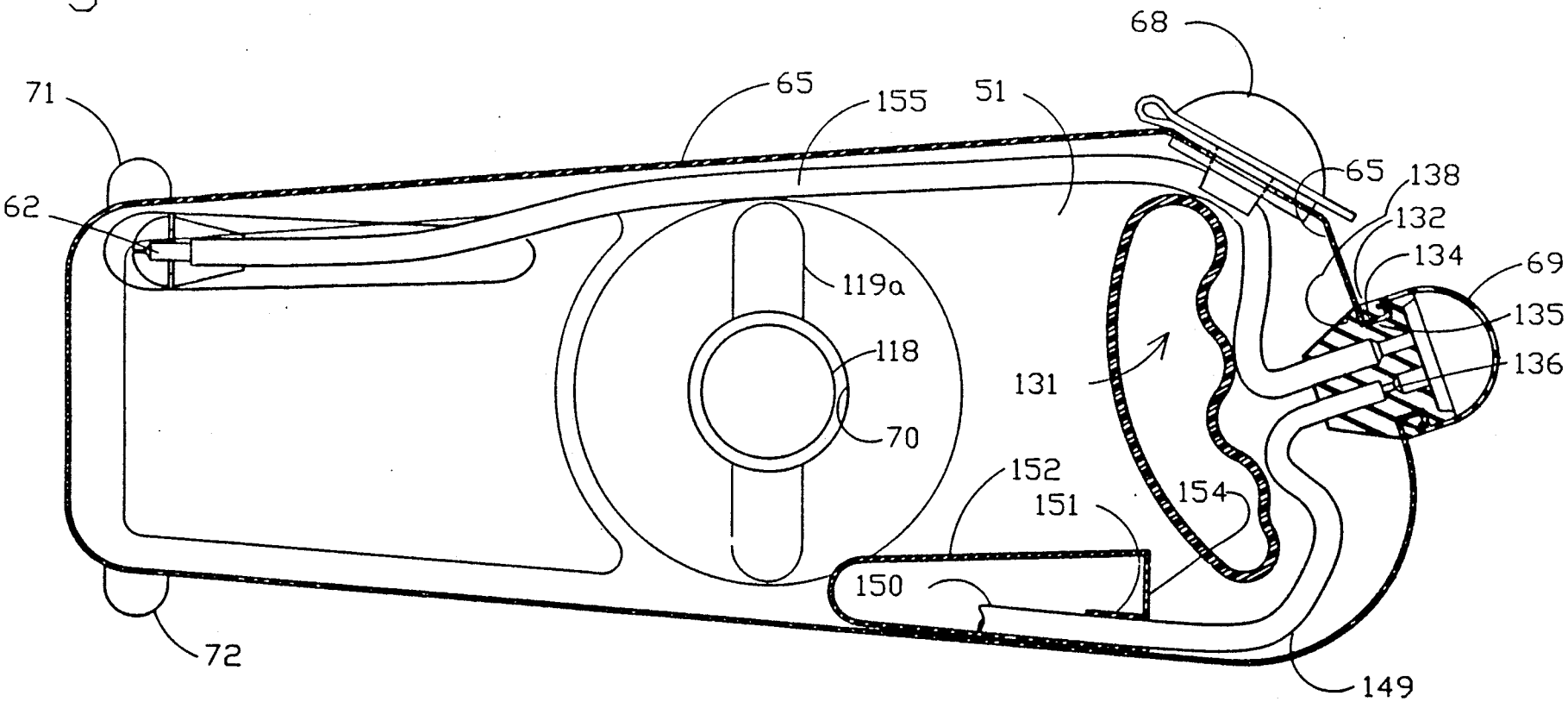
FIG. 16 is a side elevational view, partly in section and taken substantially along the line 16—16 in FIG. 10, here depicting details of the water ejection nozzle and actuating mechanism therefor used in one of the bellows actuating arms.

Considering next FIGS. 16, 17 and 18 conjointly, an exemplary water ejection system, generally indicated at 131 in FIG. 16, has been illustrated for enabling the user 54 to eject high pressure water streams 61 at floating target bubbles 60 as shown in FIG. 1. As best illustrated in FIG. 16, the exemplary water ejection system 131 there shown is that employed in the left actuating handle 51; but, it will be understood that an identical water ejection system is also employed in the right actuating handle 55.

To carry out this aspect of the invention, and referring first to FIG. 16, it will be noted that the palm-actuated trigger or actuator 69 comprises a generally semi-spherical, soft rubber, suction ball which is provided with an internal radial flange 132 adapted to snap into a complementally formed external radial groove 134 formed in a hollow fitting 135 integral with the blow molded plastic housing 65. A flexible rubber valve housing 136 having an external circumferential groove 138 is snap-fit into the opening defined by the hollow fitting 135. Valve housing 136, as best shown in FIGS. 17 and 18, includes: (i) a water inlet port 139 having a valve seat 140, a ball cage 141, and a ball-type closure element 142; and (ii), a water outlet port 144 having a valve seat 145, a ball cage 146, and a ball-type closure element 148. The water inlet port 139 is coupled to a tubular suction conduit 149 (FIG. 16) having an open end 150 secured to the bottom of housing 65 in any suitable manner—for example, by insertion into a cylindrical sleeve 151 forming part of a relatively large thimble-shaped water font 152 fixedly secured to housing 65, such font preferably including a filter screen 154 at its open end. A high pressure tubular water conduit 155 serves to couple the water outlet port 144 in valve housing 136 directly to the high pressure water ejection nozzle 62.

In operation, the user 54 (FIG. 1) fills the enclosed hollow blow molded housing 65 by opening the fill port closure element 68 and introducing water (not shown) into the interior of the totally enclosed housing. The user then primes the water ejection system 131 by depressing the soft rubber palm-actuated trigger or actuator 69 to collapse and evacuate the air chamber defined therein. This serves to firmly seat the valve closure ball 142 against valve seat 140 in the water inlet port 139; while, at the same time, unseating ball 148 from valve seat 145 in the high pressure water outlet port 144 and expelling the air from within the collapsed air chamber defined by the palm-actuator 69 via tube 155 and the water ejection nozzle 62.

Thereafter, release of the soft rubber palm-actuator 69 causes it to snap back to its original position, creating a partial vacuum in the air chamber defined thereby. This serves to firmly seat the ball closure element 148 against the valve seat 145 in the high pressure water outlet port 144; while, at the same time, unseating ball closure element 142 from valve seat 140 in the water inlet port 139, thereby creating suction in the conduit 149 and causing water present in the thimble-shaped font 152 to be drawn through conduit 149 and water inlet port 139 so as to fill the interior of the palm actuator 69 with water, thus priming the system. As a consequence, when the user 54 (FIG. 1) next depresses the palm actuator 69, the water contained therein is discharged through the now-open high pressure outlet port 144 in valve housing 136 and through high pressure conduit 155, exiting through the Water ejection nozzle 62 as a high pressure water stream 61, as best shown in FIG. 1.

Those skilled in the art will appreciate that usage of the thimble-shaped water font 152 serves to insure that water is available at all times to maintain the water ejection system 131 fully primed, even in those instances when the user 54 orients the toy 50 in an attitude where it is aimed downwardly or towards the ground.

D. Modified Alternative Embodiments of the Invention

Figure 19:
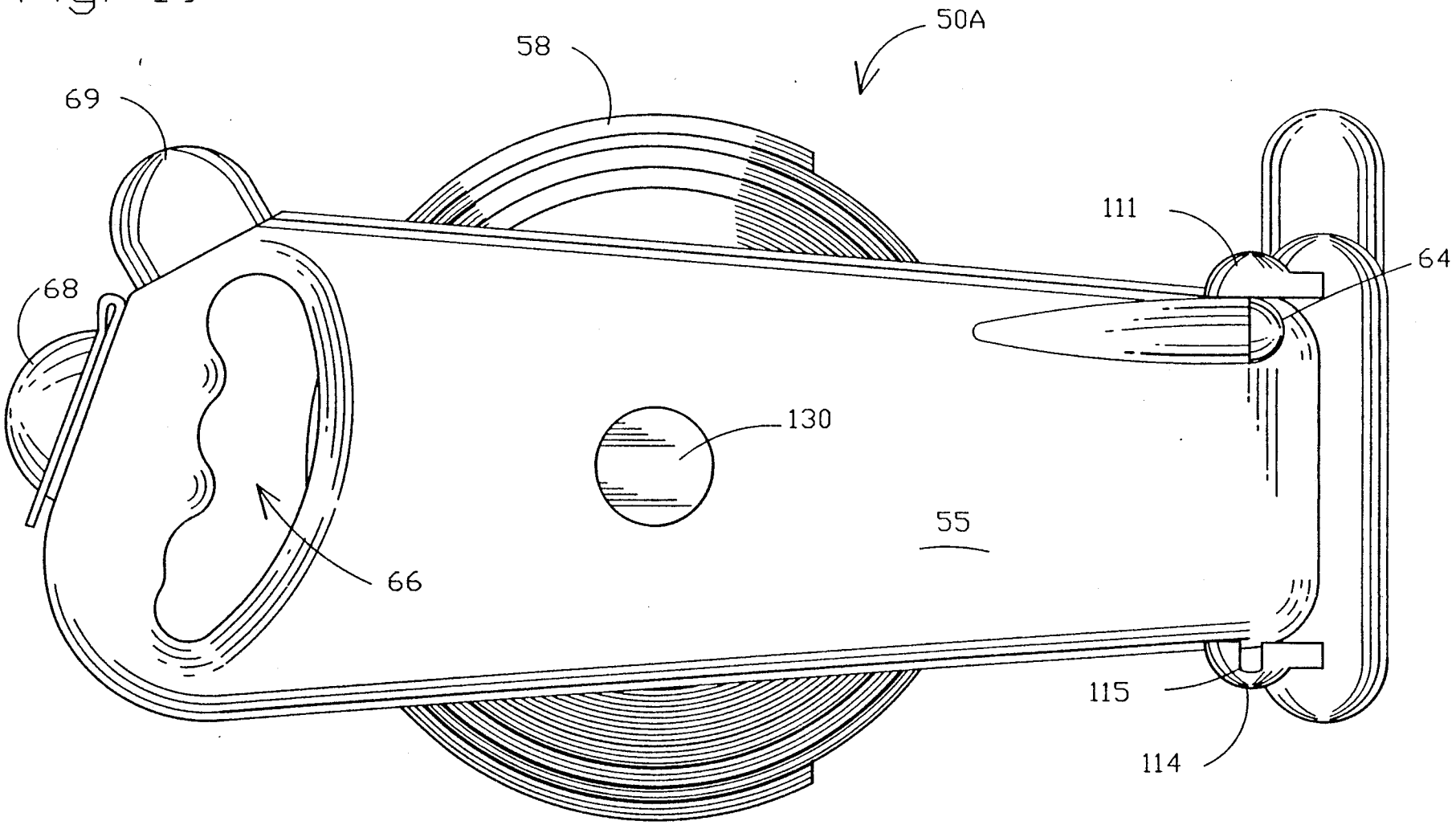
FIG. 19 is a side elevational view here depicting a slightly modified form of the invention wherein the water ejection nozzle in the bellows actuating arm is thumb actuated as contrasted with the palm actuated embodiment depicted in FIG. 16.

Referring next to FIG. 19, a slightly modified target bubble generating and target shooting system, generally indicated at 50A, has been illustrated which, for all practical purposes, is essentially identical to the system 50 previously described in connection with FIGS. 1 through 18. However, in this instance the positions of the fill port 68 and palm actuator 69 as previously shown in, for example, FIGS. 12 and 13, have been reversed—i.e., the fill port and fill port closure 68 are positioned on the hand grip 66 so as to be located under the user's palm (not shown) when the toy 50A is grasped, while the actuator or trigger 69 is now located in a position to be actuated by the user's thumb—e.g., thumb 156 as shown in FIG. 1.

Figure 20:
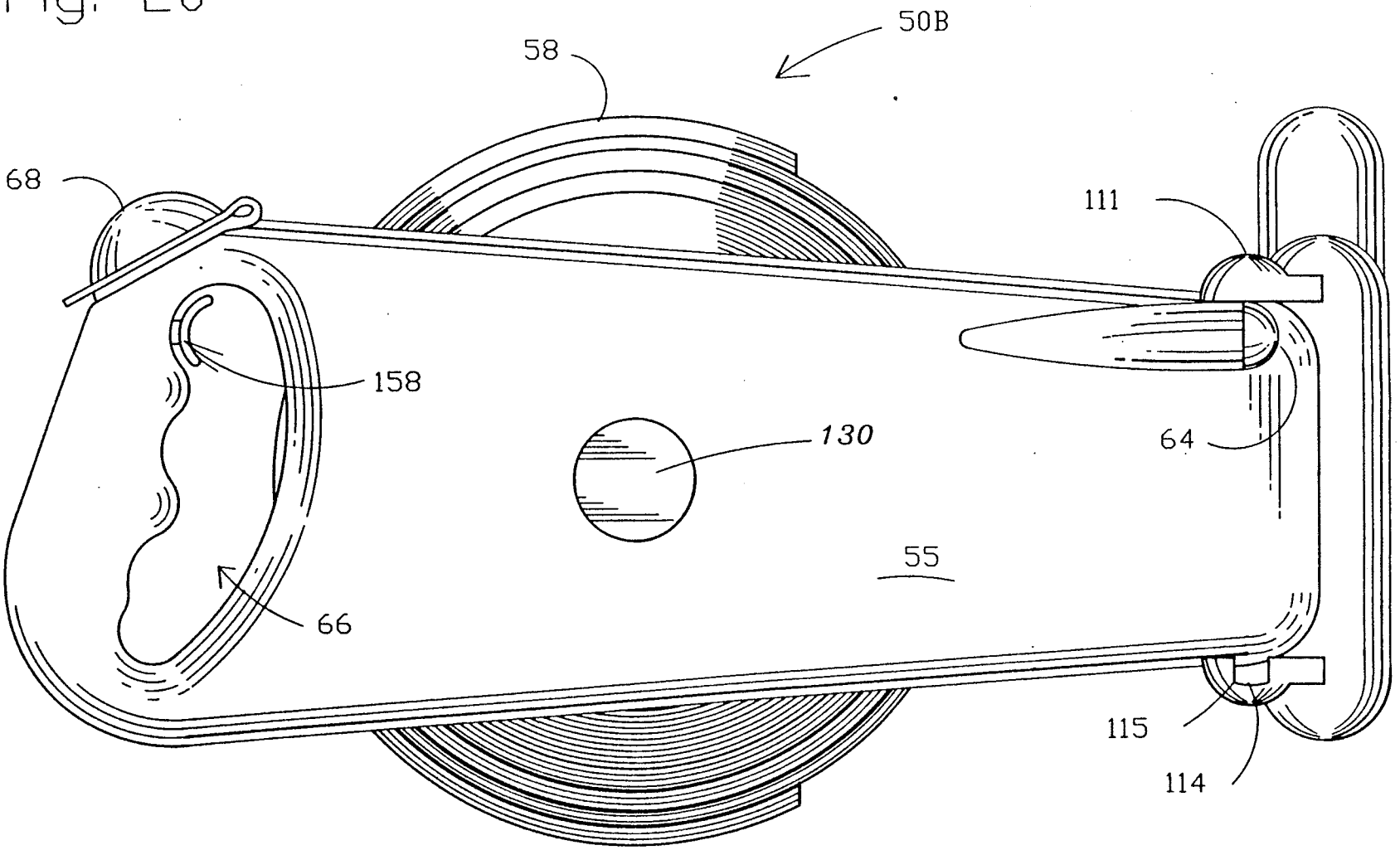
FIG. 20 is a side elevational view similar to that shown in FIG. 19, but here illustrating a still further modified form of the invention wherein the water ejection nozzle is finger actuated by means of a depressible trigger mechanism; and, FIG. 21 is a top plan view similar to FIG. 9, but here depicting a somewhat modified form of the invention wherein the hand grips on the bellows actuating handles are angled slightly outward so as to facilitate depression of the push-bulb valves with the user's palms.

And, referring to FIG. 20, another slight variation of the system, generally indicated at 50B, has been depicted. Again, the toy 50B is essentially identical to the toy 50 previously described, except that in this instance the actuator 69 has been replaced with a conventional finger-actuated trigger mechanism, generally indicated at 158, which can be employed in a conventional manner to eject high pressure water streams from the water ejection nozzle 62.

Figure 21:
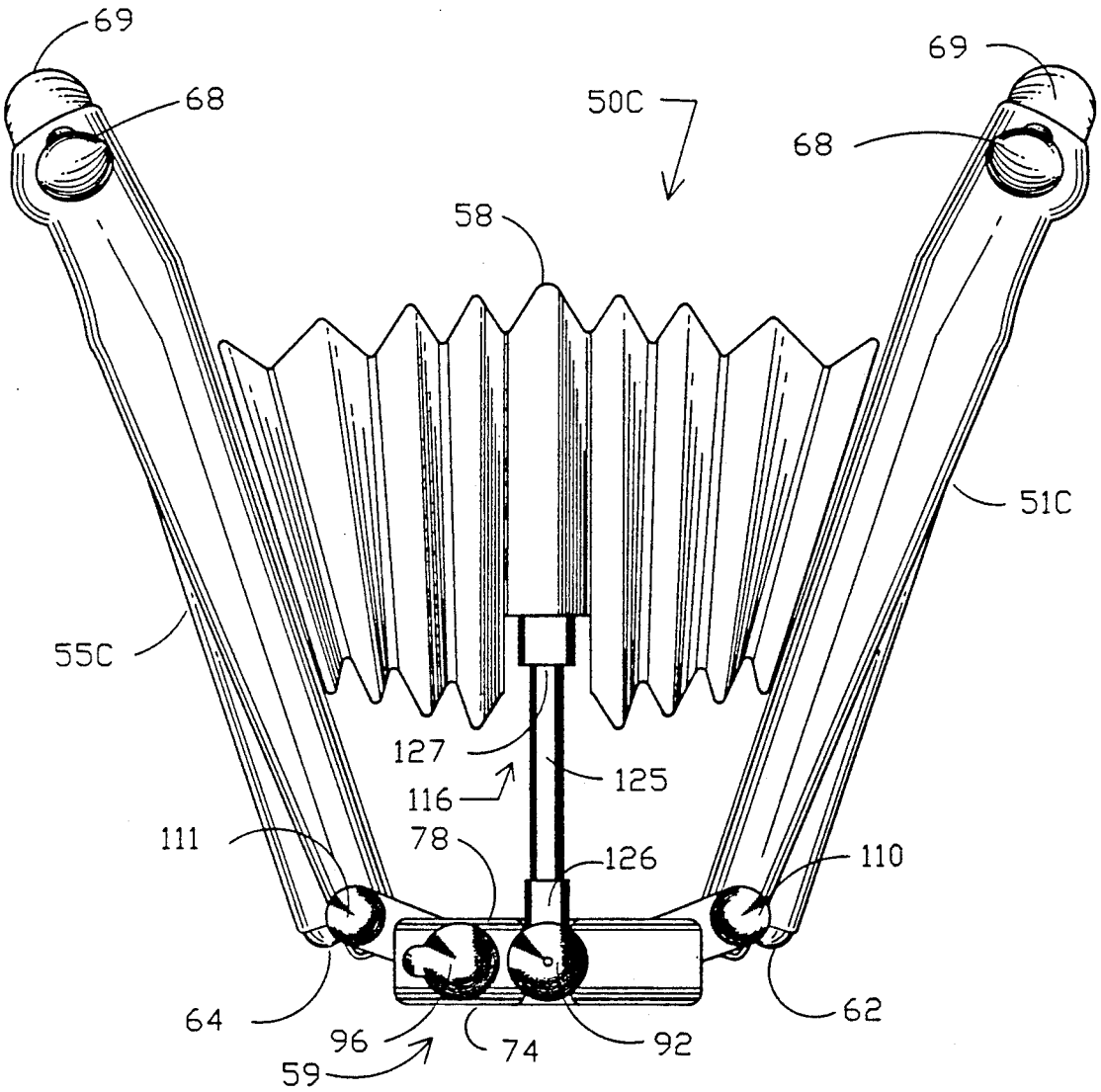

Finally, referring to FIG. 21, a still further slightly modified form of the invention, here generally indicated at 50C, has been shown which is particularly advantageous for use with palm-actuated versions of the water ejection systems such as previously illustrated and described in connection with FIGS. 1 through 18 and, particularly, FIGS. 16 through 18. Again, the toy 50C is essentially identical to those previously described except that the left and right actuating handles **51*c*, 55*c* have been slightly modified by flaring the hand grip region outwardly through a slight angle $\theta$—an angle which is preferably on the order of approximately 10°. Such outward flaring of the hand grip has been found to significantly facilitate actuation of the palm actuator 69 since it orients the actuating handles 51*c*, 55*c* so as to be more comfortable for the user 54 whose hands 52, 56 and forearms 159, 160 (FIG. 1) tend to reside in a converging attitude when the toy 50C is grasped in both hands 52, 56**.

Although not shown in the drawings, it has been found advantageous to provide the fill port closure elements 68 in the actuating handles 51, 55 with a through vent containing a uni-directional valve so as to prevent establishment of a vacuum therein as water is ejected, while at the same time preventing spillage. A similar vent/valve combination may, if desired, also be used with the closure element 96 in the bubble generator housing 59.

It will be apparent to those persons skilled in the art from the foregoing description taken in conjunction with the accompanying drawings, that highly effective non-violent water toys have herein been described which are characterized by their simplicity, their lack of movable parts (except for the vertically reciprocable bubble wand 98 and the pivotable actuating handles 51, 55), and the lack of springs, batteries and similar metallic components, which are essentially spill resistant and shatterproof, yet which are capable of effectively generating and projecting target bubbles which can then be "shot down" by the user's toy or by another's toy. Because the pneumatic for raising and lowering the bubble wand 98 is independent of the pneumatic system for stripping soapy film from the bubble wand 98 to form bubbles, and because both systems are totally separate and spaced from the soapy film-forming solution in the torus-shaped reservoir, there is absolutely no tendency to aspirate soapy film into the working parts of the toy, thus eliminating clogging and the need to disassembly the toy for purposes of cleaning. Moreover, the actuating mechanism for reciprocating the bubble wand 98 is extremely simple, lying totally in a single plane. And, the configuration of the bubble wand's elliptical ring structure 101 wherein the upper and lower serrated arcuate edges 102, 104 are shaped with a truncated triangular cross sectional configuration insures that as the bubble wand 98 exits the torus-shaped reservoir 81, the edges 102, 104 "knife" through the soapy film-forming solution, thereby minimizing disturbance of the solution and preventing breakage of the soapy film formed on the elliptical ring structure 101 as it exits the solution and the torus-shaped reservoir 81.

I claim:

1. A bubble generating amusement device comprising, in combination:

(a) housing means defining a reservoir for holding a fluid body of film-forming solution;

(b) a bubble wand having a peripherally enclosed film-forming ring structure;

(c) pneumatically actuated means mounted on said housing means for pneumatically shifting said bubble wand between first and second vertically spaced positions where said peripherally enclosed film-forming ring structure is submerged within the film forming solution in said reservoir in the first of said first and second vertically spaced positions and is retracted from the film-forming solution in said reservoir in the second of said first and second vertically spaced positions;

(d) left and right actuating handles pivotally connected adjacent their forward ends to respective ones of the left and right sides of said housing means; and, (e) a compressible/expandable bellows assembly interposed between said left and right actuating handles and connected thereto at the approximate midpoints of said handles, said bellows assembly including at least two inlet/outlet ports and means coupling one of said two inlet/outlet ports to said pneumatically actuated means mounted on said housing means, said other of said inlet/outlet ports being positioned in said bellows assembly so as to direct a stream of high pressure air axially through said peripherally enclosed ring structure and when said bellows assembly is compressed and said ring structure is disposed in said second position;

whereby, when said bellows assembly is compressed to pressurize the interior thereof, said pneumatic actuating means is actuated to shift said ring structure to said second position and the high pressure air stream exiting the other of said first and second inlet/outlet ports passes axially through said ring structure to separate the film of fluid therefrom and thus generate one or more bubbles which are projected from said amusement device by said stream of high pressure air; and, when said bellows assembly is expanded, a partial vacuum is created therein which serves to actuate said pneumatic actuator means to restore said ring structure to said first submerged position in said reservoir while air moves in the reverse direction through the other of said first and second inlet/outlet ports to restore the interior of said bellows assembly to atmospheric conditions.

2. An amusement device as set forth in claim 1 wherein at least one of said actuating handles comprises a water ejector capable of being manually activated by the user of the amusement device to direct a high pressure water stream at floating bubbles generated by either the user's amusement device or by another.

3. An amusement device as set forth in claim 1 wherein each of said left and right actuating handles comprises a water ejector capable of being selectively and manually actuated by the user of the amusement device to direct a selected one of a single high pressure water stream, two parallel high pressure water streams, two converging high pressure water streams, or two diverging high pressure water streams at floating bubbles generated by either the user's amusement device or by another.

4. An amusement device as set forth in claims 2 or 3 wherein each said water ejector includes a palm-actuated trigger mechanism.

5. An amusement device as set forth in claims 2 or wherein each said water ejector includes a thumb-actuated trigger mechanism.

6. An amusement device as set forth in claims 2 or 3 wherein each water ejector includes a finger-actuated trigger mechanism.

7. An amusement device as set forth in claims 2 or 3 wherein each said actuating handle comprising a water ejector is defined by an enclosed hollow housing forming a water reservoir, said housing including:

(i) a water ejector nozzle at its front end;

(ii) a valve member mounted in said housing adjacent a portion of said handle normally grasped by the user, said valve member having a high pressure outlet port, an inlet port, and inlet and outlet port closure elements;

(iii) means defining a resilient compressible/expandable actuator mounted on said valve member and external to said actuating handle in the region thereof normally grasped by the user's hand(s);

(iv) a suction conduit coupling said inlet port to said water reservoir; and, (v) a high pressure conduit coupling said outlet port to said water ejection nozzle;

whereby, when said resilient compressible/expandable actuator is compressed, said inlet port closure element is closed, said outlet port closure element is opened, and the fluid contents of the interior of said compressible/expandable actuator is ejected through said outlet port, said high pressure conduit and said ejector nozzle to create a high pressure fluid stream suitable for shooting down floating bubbles; and, when said resilient compressible/expandable actuator is expanded, said outlet port closure element is closed, said inlet port closure element is opened, and water in said water reservoir is drawn into the interior of said resilient compressible/expandable actuator for use in generating a high pressure water stream exiting said ejector nozzle when said resilient compressible/expandable actuator is again compressed.

8. An amusement device as set forth in claims 1, 2 or 3 wherein said compressible/expandable bellows assembly includes a third inlet/outlet port; and, an audible sound generator is coupled to said third inlet/outlet port.

9. A bubble generating amusement device comprising, in combination:

(a) a torus-shaped reservoir for containing a body of film-forming solution, said reservoir including a central through axial opening and a vertically-oriented cylinder mounted above said central through axial opening and radial with respect thereto;

(b) a bubble forming wand including a peripherally-enclosed ring structure having upper and lower arcuate edges, a vertically-extending piston rod integral with said upper edge, and a piston head on said piston rod slidably received within said cylinder, said bubble forming wand being normally positioned within said torus-shaped reservoir with said ring structure below said central through axial opening and within the body of film-forming solution contained therein and with said piston head being disposed within and adjacent the lower end of said cylinder;

(c) a left actuating handle pivotally coupled adjacent its front end to the left side of said torus-shaped reservoir;

(d) a right actuating handle pivotally coupled adjacent its front end to the right side of said torus-shaped reservoir;

(e) means defining an enclosed compressible/expandable air chamber interposed between said left and right actuating handles and having its opposite ends affixed to respective ones of said left and right actuating handles adjacent the approximate mid-points thereof; and, (f) first and second inlet/outlet ports formed in said compressible/expandable air chamber defining means, said first air inlet/outlet port including means coupling said first port to the lower end of said cylinder in said torus-shaped reservoir and said second port positioned to direct a high pressure air stream axially through said central through axial opening in said torus-shaped reservoir;

whereby, when said left and right actuating handles are moved towards one another, said compressible/expandable air chamber defining means is compressed so as to pressurize the interior thereof and eject air through said first and second air inlet/outlet ports with the air directed through said first air inlet/outlet port serving to pressurize the lower end of said cylinder in said torus-shaped reservoir and to thus shift said piston head and said bubble wand vertically upward to retract said ring structure from the film-forming solution in said torus-shaped reservoir and center said ring structure within said central through axial opening, and with the air directed through said second air inlet/outlet port forming a high pressure air stream directed axially through said central through axial opening in said reservoir and through said raised ring structure so as to strip the film of film-forming solution therefrom and to generate and project one or more bubbles axially from said torus-shaped reservoir; and, so that when said left and right actuating handles are shifted away from one another, said compressible/expandable air chamber defining means is expanded to create a partial vacuum therein, thus reducing the pressure in said cylinder in said torus-shaped reservoir to below atmospheric and affirmatively retracting said piston head and said bubble wand so as to shift said ring structure downwardly out of said central through axial opening and return said ring structure to a position submerged within the film-forming solution in said reservoir while the air within said compressible/expandable air, chamber defining means is replenished by reverse air movement through said second air inlet/outlet port and restored to atmospheric pressure conditions.

10. An amusement device as set forth in claim 9 wherein said means defining an enclosed compressible/expandable air chamber comprises a bellows.

11. An amusement device as set forth in claim 9 wherein at least one of said actuating handles comprises a water ejector capable of being manually activated by the user of the amusement device to direct a high pressure water stream at floating bubbles generated by either the user's amusement device or by another.

12. An amusement device as set forth in claim 9 wherein each of said left and right actuating handles comprises a water ejector capable of being selectively and manually actuated by the user of the amusement device to direct a selected one of a single high pressure water stream, two parallel high pressure water streams, two converging high pressure water streams, or two diverging high pressure water streams at floating bubbles generated by either the user's amusement device or by another.

13. An amusement device as set forth in claims 11 or 12 wherein each said water ejector includes a palm-actuated trigger mechanism.

14. An amusement device as set forth in claims 11 or 12 wherein each said water ejector includes a thumb-actuated trigger mechanism.

15. An amusement device as set forth in claims 11 or 12 wherein each water ejector includes a finger-actuated trigger mechanism.

16. An amusement device as set forth in claims 11 or 12 wherein each said actuating handle comprising a water ejector is defined by an enclosed hollow housing forming a water reservoir, said housing including:

(i) a water ejector nozzle at its front end;

(ii) a valve member mounted in said housing adjacent a portion of said handle normally grasped by the user, said valve member having a high pressure outlet port, an inlet port, and inlet and outlet port closure elements;

(iii) means defining a resilient compressible/expandable actuator mounted on said valve member and external to said actuating handle in the region thereof normally grasped by the user's hand(s);

(iv) a suction conduit coupling said inlet port to said water reservoir; and, (v) a high pressure conduit coupling said outlet port to said water ejection nozzle;

whereby, when said resilient compressible/expandable actuator is compressed, said inlet port closure element is closed, said outlet port closure element is opened, and the fluid contents of the interior of said compressible/expandable actuator is ejected through said outlet port, said high pressure conduit and said ejector nozzle to create a high pressure fluid stream suitable for shooting down floating bubbles; and, when said resilient compressible/expandable actuator is expanded, said outlet port closure element is closed, said inlet port closure element is opened, and water in said water reservoir is drawn into the interior of said resilient compressible/expandable actuator for use in generating a high pressure water stream exiting said ejector nozzle when said resilient compressible/expandable actuator is again compressed.

17. An amusement device as set forth in claims 9, 10, 11 or 12 wherein said compressible/expandable air chamber defining means includes a third inlet/outlet port; and, an audible sound generator is coupled to said third inlet/outlet port.

18. A bubble generating housing for use with bubble forming amusement devices, said bubble generating housing comprising, in combination:

(a) front and rear housing elements each having complemental central through axial openings with said housing elements permanently affixed together in edge-to-edge relation and defining a substantially enclosed torus-shaped reservoir for holding a fluid body of film-forming solution, said front and rear housing elements defining:

(i) an arcuate gap therebetween at the lower edge of said complemental central through axial openings;

(ii) vertically oriented, spaced, left and right pairs of track-defining means adjacent the left and right edges of said complemental through axial openings; and, (iii) a vent hole in said housing;

(b) a cylinder mounted in the said housing between said front and rear housing elements above said complemental central through axial openings and below said vent hole and disposed concentrically about a vertical axis lying in the plane between, and bisecting, said complemental central through axial openings;

(c) a bubble wand comprising a peripherally enclosed film-forming ring structure disposed within said torus-shaped reservoir and having upper and lower spaced arcuate edges and an integral vertically upstanding piston lying in the plane of said ring structure and extending upwardly from the midpoint of said upper arcuate edge, said piston including a piston head slidably mounted within said cylinder, said ring structure including left and right spaced, parallel, vertically-extending guide rails dimensioned to be slidably received within respective ones of said left and right track defining means; and, (d) means for periodically introducing a fluid medium under pressure into said cylinder below said piston head so as to cause said piston head to be affirmatively shifted upwardly through said cylinder, thus causing said peripherally enclosed ring structure to be shifted vertically upward through said arcuate gap with said left and right guide rails sliding upwardly through respective ones of said left and right track-defining means to center said ring structure within said complemental through axial openings, thus permitting any film formed on said ring structure to be separated therefrom so as to form bubbles by directing an air stream through said complemental through axial openings and said ring structure centered therein.

19. A bubble-generating housing as set forth in claim 18 wherein said upper and lower spaced arcuate edges of said film-forming ring structure on said bubble wand are serrated so as to increase the surface area thereof and, therefore, the quantity of film-forming solution retainable thereby.

20. A bubble generating housing as set forth in claims 18 or 19 wherein said bubble wand includes an arcuate flange mounted on said piston above said ring structure and defining forwardly and rearwardly projecting arcuate flange elements complemental in shape to said arcuate gap defined by said front and rear housing elements whereby when said ring structure is mounted within said torus-shaped reservoir beneath said arcuate gap, said arcuate flange substantially closes said arcuate gap so as to minimize the danger of spillage of the fluid body of film-forming solution in said reservoir.

21. A bubble generating housing as set forth in claim 18 or 19 wherein said upper and lower spaced arcuate edges of said ring structure are of truncated triangular cross-sectional configuration with the truncated apicad ends thereof directed upwardly so that as said ring structure moves through and exits from the fluid body of film-forming solution in said reservoir, said ring structure knifes through the fluid so as to minimize disturbance of the fluid body and thus minimize the danger of spillage of the fluid as said ring structure exits said reservoir.

22. A bubble generating housing as set forth in claim 20 wherein said upper and lower spaced arcuate edges of said ring structure are of truncated triangular cross-sectional configuration with the truncated apicad ends thereof directed upwardly so that as said ring structure moves through and exits from the fluid body of film-forming solution in said reservoir, said ring structure knifes through the fluid so as to minimize disturbance of the fluid body and thus minimize the danger of spillage of the fluid as said ring structure exits said reservoir.

23. A bubble generating housing as set forth in claim 18 wherein said bubble wand is permitted to move downwardly under the influence of gravity during alternate periods between those periods when a fluid under pressure is introduced into said cylinder beneath said piston head so as to permit return of said ring structure to said reservoir of film-forming solution.

24. A bubble generating housing as set forth in claims 18 or 23 wherein said means for periodically introducing a fluid under pressure into said cylinder below said piston head further includes means for alternately reducing the pressure in said cylinder below said piston head to sub-atmospheric so as to affirmatively retract said bubble wand to its lowermost position with said ring structure disposed within said reservoir of film-forming solution.

25. A bubble wand for use with bubble-blowing amusement devices, said wand comprising, in combination:

(a) a peripherally enclosed film-forming ring structure having vertically spaced upper and lower edges;

(b) said upper and lower edges each having a truncated triangular cross-sectional configuration with the truncated apicad portions thereof each directed vertically upward so that when said ring structure is moved upwardly through a fluid body of film-forming solution and exits therefrom, said upper and lower edges knife through the fluid body with minimal disturbance thereof, thus minimizing the danger of spillage of fluid as said ring structure exits the fluid body; and, (c) means extending upwardly from said upper edge of said ring structure for permitting said ring structure to be introduced into and removed from a fluid body of film-forming solution.

26. A bubble wand as set forth in claim 25 wherein said upper and lower edges of said peripherally enclosed film-forming ring structure are serrated so as to form teeth thereon for insuring that when said ring structure is inserted into and removed from a body of film-forming solution, a sufficient quantity of such solution is attracted to and retained by said ring structure to permit generation of multiple bubbles upon direction of an air stream through said ring structure.

27. A bubble wand as set forth in claims 25 or 26 wherein said means extending upwardly from said upper edge of said ring structure for permitting said ring structure to be introduced into and removed from a fluid body of film-forming solution comprises a piston having a piston head formed thereon.

28. A bubble wand as set forth in claims 25 or 26 wherein said peripherally enclosed film-forming ring structure includes left and right spaced vertical guide rails.

29. A bubble wand as set forth in claim 27 wherein said peripherally enclosed film-forming ring structure includes left and right spaced vertical guide rails.

30. The method of forming bubbles comprising the steps of:

(a) establishing a torus-shaped reservoir having a central through axial opening and a cylinder disposed above the opening and lying in the plane of the opening on a vertical axis passing radially through the opening;

(b) positioning a bubble wand having a peripherally enclosed ring structure within the torus-shaped reservoir with freedom for vertical reciprocation between a first lower position wherein the ring-shaped structure is disposed within a film-forming fluid body in the reservoir and a second elevated position wherein the ring structure is centered within the central through axial opening in the torus-shaped reservoir, the bubble wand further including an integral piston having a piston head slidably received within the cylinder;

(c) pivotally coupling left and right actuating handles to respective ones of the left and right sides of the torus-shaped reservoir adjacent the front ends of the handles;

(d) positioning a compressible/expandable air chamber between the left and right actuating handles and coupling the opposite ends of the chamber to the left and right handles adjacent the approximate midpoints thereof;

(e) coupling a first air inlet/outlet port formed in the compressible/expandable air chamber to the lower end of the cylinder in the torus-shaped reservoir;

(f) forming a second air inlet/outlet port in the compressible/expandable air chamber positioned to direct an air stream axially through the central through axial opening in the torus-shaped reservoir;

(g) moving the left and right actuating handles towards one another to compress the compressible/expandable air chamber, thus pressurizing the lower end of the cylinder in the torus-shaped reservoir and shifting the piston head and bubble wand upwardly to retract the ring structure from the film-forming fluid body and position the film-covered ring structure centrally within the central through axial opening within the torus-shaped reservoir while simultaneously directing an air stream from the second air inlet/outlet port in the compressible/expandable air chamber axially through the central through axial opening in the torus-shaped reservoir and through the raised ring structure centered therein so as to strip the film formed thereon from the ring structure, forming such film into one or more bubbles, and projecting the formed bubbles axially from the torus-shaped reservoir; and, (h) moving the left and right actuating handles away from one another so as to expand the compressible/expandable air chamber, thus creating a partial vacuum therein and lowering the pressure at the lower end of the cylinder within the torus-shaped reservoir to below atmospheric so as to affirmatively retract the piston head within the cylinder and lower the ring structure of the bubble wand back into the film-forming fluid body contained within the reservoir while simultaneously permitting replenishment of the air supply within the compressible/expandable air chamber and restoring atmospheric pressure conditions therein by reverse flow of air through the second air inlet/-outlet port.

31. The method of generating floating bubbles and thereafter shooting down generated bubbles floating in the air comprising the steps of:

(a) establishing a torus-shaped reservoir having a central through axial opening and a cylinder disposed above the opening and lying in the plane of the opening on a vertical axis passing radially through the opening;

(b) positioning a bubble wand having a peripherally enclosed ring structure within the torus-shaped reservoir with freedom for vertical reciprocation between a first lower position wherein the ring-shaped structure is disposed within a film-forming fluid body in the reservoir and a second elevated position wherein the ring structure is centered within the central through axial opening in the torus-shaped reservoir, the bubble wand further including an integral piston having a piston head slidably received within the cylinder;

(c) pivotally coupling left and right actuating handles to respective ones of the left and right sides of the torus-shaped reservoir adjacent the front ends of the handles, each of the left and right actuating handles comprising an enclosed hollow housing defining a water reservoir and each including:

(i) a fill port;

(ii) an ejection nozzle;

(iii) a trigger actuator;

(iv) a suction line coupling the reservoir to the trigger actuator; and, (v) a high pressure ejection line coupling the trigger actuator to the ejection nozzle;

(d) positioning a compressible/expandable air chamber between the left and right actuating handles and coupling the opposite ends of the chamber to the left and right handles adjacent the approximate midpoints thereof;

(e) coupling a first air inlet/outlet port formed in the compressible/expandable air chamber to the lower end of the cylinder in the torus-shaped reservoir;

(f) forming a second air inlet/outlet port in the compressible/expandable air chamber positioned to direct an air stream axially through the central through axial opening in the torus-shaped reservoir;

(g) moving the left and right actuating handles towards one another to compress the compressible/expandable air chamber, thus pressurizing the lower end of the cylinder in the torus-shaped reservoir and shifting the piston head and bubble wand upwardly to retract the ring structure from the film-forming fluid body and position the film-covered ring structure centrally within the central through axial opening within the torus-shaped reservoir while simultaneously directing an air stream from the second air inlet/outlet port in the compressible/expandable air chamber axially through the central axial opening in the torus-shaped reservoir and through the raised ring structure centered therein so as to strip the film formed thereon from the ring structure, forming such film into one or more bubbles, and projecting the formed bubbles axially from the torus-shaped reservoir;

(h) moving the left and right actuating handles away from one another so as to expand the compressible/expandable air chamber, thus creating a partial vacuum therein and lowering the pressure at the lower end of the cylinder within the torus-shaped reservoir to below atmospheric so as to affirmatively retract the piston head within the cylinder and lower the ring structure of the bubble wand back into the film-forming fluid body contained within the reservoir while simultaneously permitting replenishment of the air supply within the compressible/expandable air chamber and restoring atmospheric pressure conditions therein by reverse flow of air through the second air inlet/-outlet port; and, (i) manually actuating at least one of the trigger actuators in the left and right actuating handles to direct a high pressure water stream exiting from at least one of the ejector nozzles.

32. The method as set forth in claim 31 wherein both trigger actuators are manually actuated to direct a pair of high pressure water streams from the ejection nozzles in the left and right actuating handles while controlling the positions of the actuating handles to permit directing the pair of high pressure water streams along a selected one of parallel, converging and diverging trajectories.

33. The method of generating floating bubbles and then shooting such bubbles down with an amusement device including:

(i) a bubble generating housing defining a reservoir for film-forming solution;

(ii) a vertically oriented cylinder mounted in the bubble generating housing and spaced above the reservoir;

(iii) a bubble wand mounted in the bubble generating housing with freedom for reciprocable movement between first and second limit positions, the bubble wand including: (a) an enclosed film-forming ring structure adapted to be positioned within the reservoir at the first limit position and intermediate the reservoir and the cylinder at the second limit position; and (b), a piston integral with and extending vertically upward from the ring structure and terminating in a piston head slidably received within the cylinder;

(iv) left and right actuating handles pivotally coupled adjacent their front ends to the left and right sides of the bubble generating housing, each of the left and right actuating handles comprising a hollow enclosed housing defining a water reservoir and each including: (a) an ejector nozzle at the front end of the housing; (b) a fill port; (c) a valve assembly in the portion of the handle normally grasped by the user with the valve assembly including a high pressure outlet valve coupled to the ejector nozzle and an inlet valve coupled to the reservoir; and (d), a compressible/expandable actuator associated with the valve assembly and defining a normally expanded resilient fluid air chamber; and, (v) a compressible/expandable bellows assembly positioned intermediate the left and right actuating handles and connected thereto at the approximate midpoints of each handle, the bellows assembly including at least two inlet/outlet ports with one inlet/outlet port being coupled directly to the lower end of the cylinder and the other inlet/outlet port being directed axially through the ring structure when the ring structure is disposed in the second limit position;

said method comprising the steps of:

(a) manually shifting the left and right actuating handles towards one another so as to compress the bellows assembly and pressurize the interior thereof, thereby pressurizing the lower end of the cylinder and shifting the ring structure from the first limit position submerged within the film-forming solution in the bubble generating housing reservoir to the second limit position while simultaneously directing a high pressure air stream axially through the raised ring structure from the other inlet/outlet port in the bellows assembly so as to strip the film from the ring structure, form one or more bubbles therefrom, and project the formed bubbles axially from the amusement device;

(b) compressing the compressible/expandable actuator associated with the valve assembly mounted on at least one of the left and right actuating handles to direct at least one high pressure stream of water from at least one ejection nozzle;

(c) adjusting the position of the one(s) of the left and right actuating handles from which a high pressure water stream is emanating so as to direct the water stream(s) at a floating bubble in an attempt to shoot down the bubble; and, (d) manually shifting the left and right actuating handles away from one another so as to expand the bellows assembly, thus creating a partial vacuum therein and reducing the pressure in the cylinder below the piston head to sub-atmospheric so as to shift the ring structure from the second limit position back to the first limit position while at the same time reversing the flow of air through the other air inlet/outlet port in the bellows assembly so as to replenish the air supply therein and restore the interior of the bellows assembly to atmospheric pressure conditions.

34. The method as set forth in claim 33 wherein the compressible/expandable actuators associated with the valve assemblies mounted in both the left and right actuating handles are compressed to direct a pair of high pressure water streams from the ejector nozzles at the front ends of both the left and right actuating handles during step (b) and wherein the left and right actuating handles are adjusted during step (c) to direct the pair of high pressure water streams along a selected one of parallel trajectories, converging trajectories and diverging trajectories.

35. A pump-like valve assembly for permitting manual ejection of a high pressure fluid stream from a fluid body, said valve assembly comprising, in combination:

(a) a valve housing having first and second opposite ends, an inlet port in said first end adapted to be coupled to a fluid suction line terminating in the fluid body, a high pressure outlet port in said first end, and first and second through fluid paths extending axially therethrough and respectively coupling said inlet and outlet ports to said second end of said valve housing;

(b) said first fluid path including a first annular valve seat proximate said inlet port, a first ball cage proximate said second end, and a first ball-type closure element loosely trapped between said first seat and said first cage;

(c) said second fluid path including a second annular valve seat proximate said second end, a second ball cage proximate said outlet port, and a second ball-type closure element loosely trapped between said second seat and said second cage; and, (d) a resilient, compressible/expandable, semi-spherical, ball-type actuator mounted on said second end of said valve housing and defining an enclosed compressible/expandable fluid chamber communicating with said first and second fluid paths; whereby, when said actuator is manually compressed, said first ball-type closure element is urged into tight sealed engagement with said first seat closing said inlet port and said second ball-type closure element is urged away from said second seat opening said outlet port so that the fluid contents of said fluid chamber are ejected through said second fluid path and said outlet port; and, when said compressed actuator is released, it expands, creating a partial vacuum in said fluid chamber, seating said second ball-type closure element against said second seat to close said outlet port and unseating said first ball-type closure element from said first seat to open said inlet port and permit replenishment of fluid within said fluid chamber by a suction drawn through said inlet port.

* * * * *